US010143269B2

(12) United States Patent
Leo

(10) Patent No.: US 10,143,269 B2
(45) Date of Patent: Dec. 4, 2018

(54) SHOE CHARM HOLDER DEVICE

(71) Applicant: Susan Leo, Newfane, NY (US)

(72) Inventor: Susan Leo, Newfane, NY (US)

( * ) Notice: Subject to any disclaimer, the term of this patent is extended or adjusted under 35 U.S.C. 154(b) by 968 days.

(21) Appl. No.: 14/244,412

(22) Filed: Apr. 3, 2014

(65) Prior Publication Data

US 2014/0215859 A1 Aug. 7, 2014

Related U.S. Application Data

(63) Continuation-in-part of application No. 13/734,003, filed on Jan. 4, 2013, which is a continuation-in-part of application No. 13/421,927, filed on Mar. 16, 2012, which is a continuation-in-part of application No. 12/859,916, filed on Aug. 20, 2010, now Pat. No. 8,544,196.

(51) Int. Cl.

| | |
|---|---|
| ***A43B 23/00*** | (2006.01) |
| ***A43B 23/24*** | (2006.01) |
| ***A44C 17/02*** | (2006.01) |
| ***A44C 25/00*** | (2006.01) |

(52) U.S. Cl.

CPC ..... *A43B 23/24* (2013.01); *A44C 17/02* (2013.01); *A44C 25/007* (2013.01); *Y10T 24/13* (2015.01)

(58) Field of Classification Search

CPC ..... Y10T 24/13; A43B 23/24; A44C 17/02; A44C 25/007; B42F 3/00

USPC ..... 36/136, 137; 2/245, 243.1; 24/103, 24/114.5

See application file for complete search history.

(56) References Cited

U.S. PATENT DOCUMENTS

| | | | | |
|---|---|---|---|---|
| 818,983 | A * | 4/1906 | Smith | A44B 1/08 24/114.1 |
| 979,361 | A | 12/1910 | Vulpescu | |
| 1,414,748 | A | 5/1922 | Palmer | |
| 1,484,785 | A | 2/1924 | Hiss | |
| 1,919,095 | A | 7/1933 | De Gennaro | |
| 1,977,995 | A * | 10/1934 | Morali | A43B 3/0078 12/142 R |
| 2,096,335 | A | 10/1937 | Nicholas | |
| 2,139,885 | A | 12/1938 | De Gironimo | |
| 2,174,521 | A | 10/1939 | Lancaster | |
| 2,470,200 | A | 5/1949 | Wallach | |

(Continued)

FOREIGN PATENT DOCUMENTS

WO WO2013007895 * 1/2013 ..... A43B 1/0081

OTHER PUBLICATIONS

United States Patent and Trademark Office, Non-Final Office Action dated, Nov. 25, 2013 for U.S. Appl. No. 13/421,927.

(Continued)

*Primary Examiner* — Timothy K Trieu
(74) *Attorney, Agent, or Firm* — Hansen IP Law PLLC

(57) ABSTRACT

A charm holder device for attaching charms to a shoe is shown and described. The charm holder device allows a charm to be selectively attached to and detached from the shoe. A charm keeper is attached to the decorative body for attaching charms. In some of the described examples, the charm holder device is placed between the heel of the shoe and a ground-contacting portion of the shoe's sole such that the charm holder and the charm are spaced apart from the ground-contacting portion of the sole in a direction perpendicular to the ground-contacting portion of the sole.

22 Claims, 14 Drawing Sheets

(56) References Cited

U.S. PATENT DOCUMENTS 2,552,151 A 5/1951 Cohen
2,689,417 A 9/1954 Bernstein et al.
2,723,344 A 11/1955 Greminger
2,748,517 A 6/1956 Berkis
3,141,211 A 7/1964 Blake
3,354,561 A 11/1967 Cameron
3,357,063 A 12/1967 Eiben
3,722,565 A 3/1973 Miller et al.
3,787,935 A * 1/1974 Kapitan ..... A44B 1/28 24/113 MP
3,893,247 A 7/1975 Dana, III
3,946,505 A 3/1976 Dana, III
4,033,243 A 7/1977 Kirrish et al.
4,050,167 A 9/1977 Senter
4,128,861 A 12/1978 Pelengaris
4,164,971 A 8/1979 Strand
4,202,117 A 5/1980 Bidegain
4,490,083 A 12/1984 Rebish
4,724,628 A 2/1988 Schreiner
4,805,320 A 2/1989 Goldenberg et al.
4,887,369 A 12/1989 Bailey et al.
5,079,857 A 1/1992 Clifton
5,243,776 A 9/1993 Zelinko
5,244,326 A 9/1993 Henriksen
5,290,131 A 3/1994 Henriksen
5,371,662 A 12/1994 Shenk-Ko
5,461,814 A 10/1995 Reid et al.
5,490,338 A 2/1996 Hwang et al.
5,549,234 A 8/1996 Hong
5,655,317 A 8/1997 Grant
5,673,501 A 10/1997 Mathews
5,926,980 A 7/1999 Adam
6,012,763 A 1/2000 Clemente et al.
6,115,946 A 9/2000 Morris et al.
6,266,853 B1 7/2001 Ho
6,345,472 B1 2/2002 Taylor
6,354,231 B1 3/2002 Morris
6,389,712 B1 5/2002 Schelling
6,434,870 B1 8/2002 Fanjoy
6,442,872 B1 9/2002 Liao
6,481,122 B2 11/2002 Brahler
6,502,332 B1 1/2003 Nakayama
6,632,168 B2 * 10/2003 Roberts ..... A61N 2/008 600/15
6,675,611 B2 1/2004 Hunter
6,698,986 B2 3/2004 Fraleigh
7,004,699 B2 2/2006 Petrok et al.
7,059,070 B2 6/2006 Omstead et al.
7,076,894 B2 7/2006 Santos et al.
7,578,075 B1 8/2009 Kemp
7,661,208 B2 2/2010 McKinney et al.
7,695,154 B2 4/2010 Ellenburg et al.
7,713,013 B2 5/2010 Sedgwick et al.
7,819,721 B1 * 10/2010 Messier ..... A41D 27/08 2/244
7,877,902 B2 2/2011 Pieriboni
7,937,966 B2 5/2011 Golove et al.
7,987,619 B2 8/2011 McKinney et al.
7,988,397 B2 8/2011 Bodin et al.
8,001,664 B2 8/2011 Pearce
8,069,583 B1 12/2011 Simchuk
8,176,658 B2 * 5/2012 Katz ..... A43B 1/0027 36/100
8,210,785 B1 7/2012 Gager
9,468,253 B2 * 10/2016 Floriot Godin ..... A43B 1/0081
2006/0026990 A1 2/2006 Carter
2006/0075662 A1 4/2006 Schupbach
2006/0180728 A1 8/2006 Abrantes
2008/0289076 A1 11/2008 Millward
2009/0049719 A1 * 2/2009 Compton ..... G09F 21/02 40/586
2009/0100869 A1 4/2009 Golove et al.
2009/0249654 A1 10/2009 Baucom et al.
2010/0185259 A1 * 7/2010 Shiba ..... A61H 39/002 607/48
2010/0239386 A1 9/2010 Sedgwick et al.
2010/0289971 A1 11/2010 Odland et al.
2010/0307031 A1 12/2010 Ganito
2011/0083341 A1 4/2011 Baum
2012/0137474 A1 * 6/2012 Erikson ..... A44B 1/04 24/3.1
2012/0137543 A1 6/2012 Kemp
2012/0186105 A1 7/2012 Kemp et al.
2012/0297647 A1 * 11/2012 Whigham ..... A43B 3/126 36/136

OTHER PUBLICATIONS

United States Patent and Trademark Office, Final Office Action dated, May 7, 2014 for U.S. Appl. No. 13/421,927.

* cited by examiner

FIG. 2
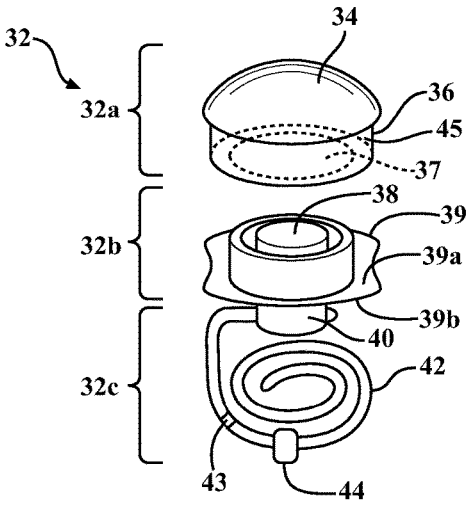
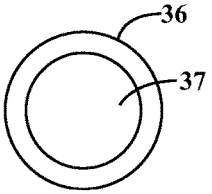
FIG. 3
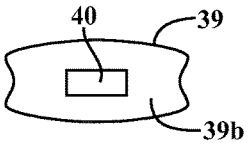
FIG. 4
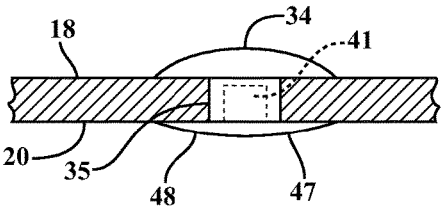
FIG. 5
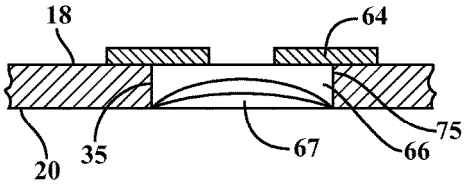
FIG. 7
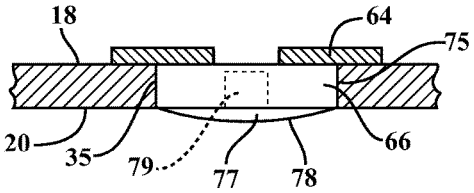
FIG. 8
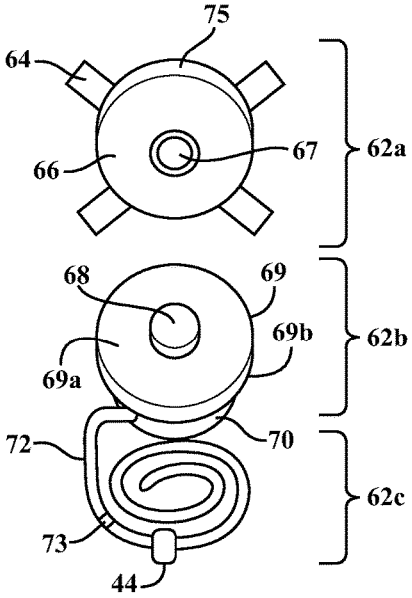
FIG. 6

SHOE CHARM HOLDER DEVICE

CROSS-REFERENCE TO RELATED APPLICATIONS

This is a continuation-in-part of U.S. patent application Ser. No. 13/734,003, filed Jan. 4, 2013, which is a continuation-in-part of U.S. patent application Ser. No. 13/421,927, filed Mar. 16, 2012, which is a continuation-in-part of U.S. patent application Ser. No. 12/859,916, filed Aug. 20, 2010, now U.S. Pat. No. 8,544,196, each of which are hereby incorporated herein by reference.

FIELD

This disclosure relates to charm holder devices for attachment to shoes.

BACKGROUND

Certain known shoe designs include a variety of fixed and selectively detachable decorative features. However, known designs do not include the ability to attach dangling charms to the sole of a shoe or other shoe surfaces with a downward facing component. Thus, a need has arisen for a charm holder device.

BRIEF DESCRIPTION OF THE DRAWINGS

FIG. 2 shows a schematic of a shoe charm holder device of a first embodiment;

FIG. 3 shows a schematic of a bottom view of the shoe engaging portion of the shoe charm holder device of a first embodiment received by an insole of a shoe;

FIG. 4 shows a schematic of a bottom view of the charm engaging portion of the shoe charm holder device of a first embodiment received by the shoe engaging portion of the shoe charm holder;

FIG. 5 shows a cap received by the attachment portion of the shoe charm holder device of a first embodiment when a wearer does not want to attach the charm engaging portion of the shoe charm holder device;

FIG. 6 shows a schematic of the attachment portion, shoe engaging portion, and the charm engaging portion of the shoe charm holder device of a second embodiment;

FIG. 7 shows a schematic of a cap of the shoe charm holder device received by an insole of a shoe of a second embodiment;

FIG. 8 shows a cap received by the attachment portion of the shoe charm holder device of a second embodiment when a wearer does not want to attach the charm engaging portion of the shoe charm holder device;

DETAILED DESCRIPTION

Figure 1:
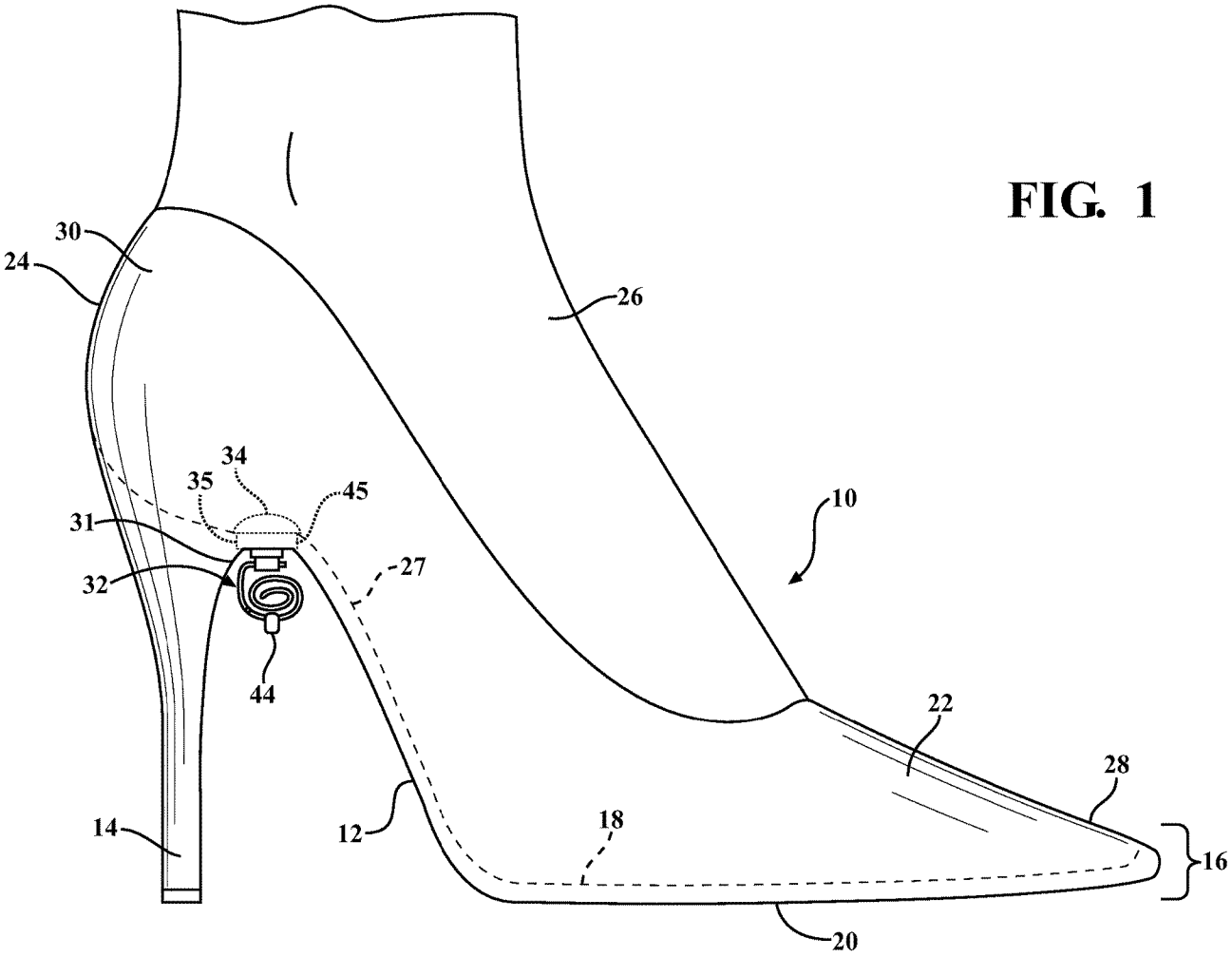
FIG. 1 shows a schematic of a shoe with a shoe charm holder device in a first an embodiment.
Figure 9:
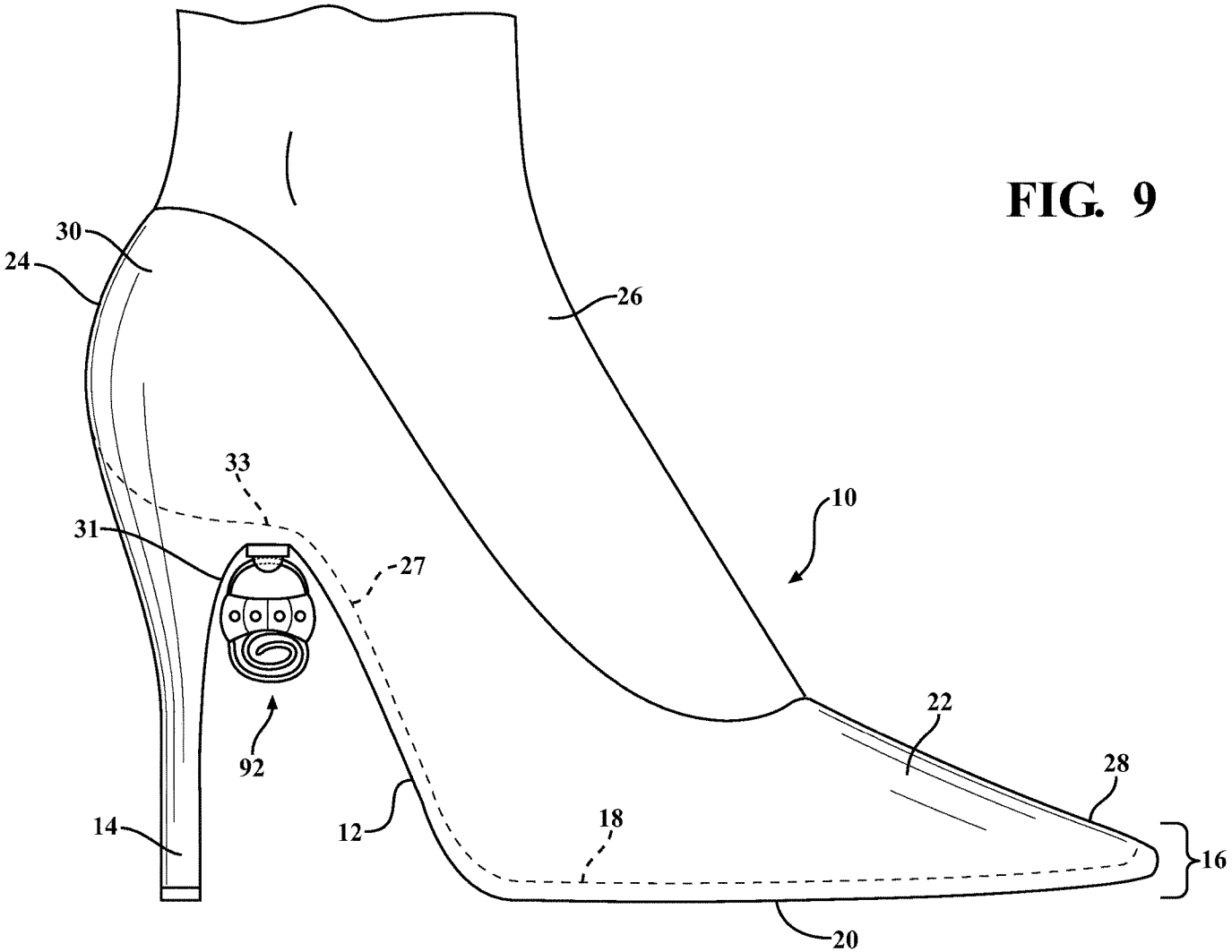
FIG. 9 shows a schematic of a shoe with a shoe charm holder device attached to an outer sole of the shoe of a third embodiment.

As shown in FIGS. 1 and 9, a shoe 10 includes a shank 12 connected to a heel 14, through a heel breast 31 and a sole assembly 16. The shoe 10 also includes an upper covering of the toe region 22 and a counter 24 to support a heel of a wearer's foot 26. The sole assembly 16 includes an insole or inner sole 18 in the interior bottom of the shoe directly beneath the wearer's foot and an outer sole or outsole 20 in contact with the ground. The insole 18 is configured with the foot shape profile of the shoe with a toe end 28, connected to an arch profile 27 corresponding to the natural curvature of the foot's arch through to a heel end 30. The outsole 20 may be made of any suitable outsole material including, but not limited to leather, PVC, polyurethane, TPR, rubber or any combination thereof.

In the first embodiment shown in FIGS. 1 through 5, a bore 35 is present on the heel breast 31 between the shank 12 and the heel 14 of the shoe. The bore 35 extends from the insole 18 through to the outsole 20. The bore 35 receives a portion of a charm holder device 32.

Referring to FIG. 2, the shoe charm holder device 32 has an attachment portion 32*a* which attaches the shoe charm holder device 32 to the shoe 10; a shoe engaging portion 32*b* which is coupled to the attachment portion 32*a* and couples the charm engaging portion 32*c* to the shoe 10; and a charm engaging portion 32*c* for receiving charms or beads 44.

In the first embodiment, the attachment portion 32*a* of the shoe charm holder device 32 includes a cap head 34 connected to a female socket 36 with outer walls 45 received by a bore 35 on the heel breast 31 of the shoe. The female socket 36 defines an opening 37 for receiving a protruding male snap stud 38 as shown in FIG. 2.

The cap head 34 is preferably mounted perpendicular to outer sides 45 of the female socket 36. The outer sides 45 of the female socket 36 are received within the bore 35. The cap head 34 preferably has a diameter that is larger than the diameter of the bore 35, preventing the cap head 34 from moving from the insole 18 to the outsole 20 through the bore 35. The cap head 34 is preferably shaped such that the cap head 34 is unobtrusive to the wearer's foot. The cap head 34 may be a pan head, a button or dome head, a round head, or a truss head, or any other type of head that is unobtrusive to the wearer's foot. In certain preferred examples, the cap head 34 is covered by a portion of a shoe upper that forms a layer covering the insole 18 and the cap head 34.

The shoe engaging portion 32*b* includes a base 39 with a first side 39*a* including a protruding male snap stud 38 and a second side 39*b* with a nipple 40 for coupling to a charm keeper 42 of the charm engaging portion 32*c* as shown in FIG. 4. The shoe engaging portion 32*b* attaches to the attachment portion by snapping the protruding male snap stud 38 into the female socket 36.

The charm keeper 42 may be fixedly attached to the nipple 40 or removably attached to the nipple 40 through a clasp (not shown). In the example of FIG. 2, the charm keeper 42 is fixedly attached to nipple 40. The charm keeper 42 has a hinge 43 which allows the charm keeper 42 to be moved from a first position in which charms or beads 44 may be added or removed from the charm keeper 42 to a second position in which charms or beads 44 are prevented from being removed or dislodged from the charm keeper 42.

Referring to FIG. 5 when a wearer does not wish to have the charm engaging portion 32*c* present on the heel breast 31 of the shoe, the shoe engaging portion 32*b* and charm engaging portion 32*c* are removed from the attachment portion 32*a*, and a separate male cap stud 48 with a head 47 is received by the female socket 36 of the attachment portion 32*a*, such that when the protruding male snap stud 41 of the separate male cap stud 48 snaps into the female socket 36, with the head 47 resting against the outer sole 20 of the shoe 10, the shoe charm holder device 32 appears flat or nearly flush with the outer sole 20 of the underside of the shoe 10. Note that in FIG. 5, the cap head 34 is depicted projecting away from the insole 18 for ease of illustration. However, in preferred examples, the cap head 34 is substantially flat and does not project away the insole 18 by an appreciable distance.

FIGS. 6-8 show an alternate charm holder device of a second embodiment received within a bore 35 on the heel breast 31 of the shoe 10 between the shank 12 and heel 14 of the shoe 10 that extends from the insole 18 through to the outsole 20.

In this embodiment, the shoe charm holder device 62 has an attachment portion 62*a* which attaches the shoe charm holder device 62 to the shoe 10; a shoe engaging portion 62*b* which is coupled to the attachment portion 62*a* and couples the charm engaging portion 62*c* to the shoe 10; and a charm engaging portion 62*c* for receiving charms or beads 44.

The attachment portion 62*a* of the shoe charm holder device 62 includes laterally extending tabs 64 that extend outwards from outer walls 75 of a female magnetic socket 66 received by the bore 35 and rest on or engage the insole 18 of the shoe 10. The tabs 64 prevent the female magnetic socket 66 from moving from the insole 18 to the outsole 20 through the bore 35. The tabs 64 lay flat on the insole 18 and are not obtrusive to the wearer's foot. The female socket 66 defines an opening 67 for receiving a protruding male snap stud 68 as shown in FIG. 6.

The shoe engaging portion 62*b* includes a base 69 with a first side 69*a* including a protruding male magnetic snap stud 68 and a second side 69*b* with a nipple 70 for coupling to a charm keeper 72 of the charm engaging portion 62*c*. The shoe engaging portion 62*b* attaches to the attachment portion 62*a* by magnetically snapping the protruding male snap stud 68 into the female socket 66.

The charm keeper 72 may be fixedly attached to the nipple 70 or removably attached to the nipple 70 through a clasp (not shown). The charm keeper 72 has a hinge 73 which allows the charm keeper 72 to be moved from a first position in which charms or beads 74 may be added or removed from the charm keeper 72 to a second position in which charms or beads 44 are prevented from being removed or dislodged from the charm keeper 72.

Referring to FIG. 8, when a wearer does not wish to have the charm engaging portion 62*c* present on the heel breast 31 of the shoe, a separate male cap stud 78 with a head 77 and a protruding male snap stud 79 is received by the female socket 66 of the attachment portion 62*a*, such that when the separate male cap stud 78 snaps into the female socket 66, with the head 77 resting against the outer sole 20 of the shoe 10, the shoe charm holder device 62 appears flat or nearly flush with the outer sole 20 of the underside of the shoe 10.

Figure 10:
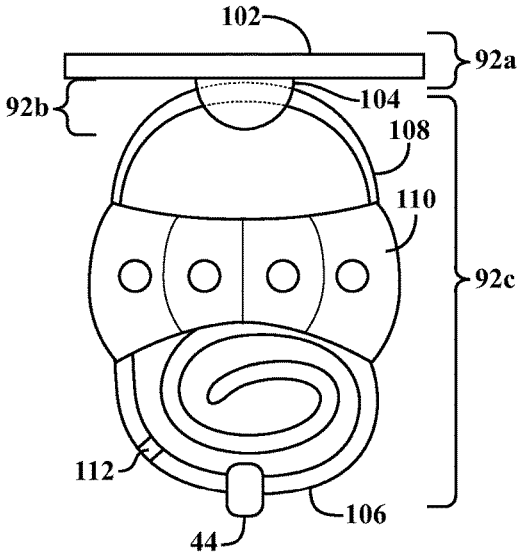
FIG. 10 shows an example of a shoe charm holder device design for attachment to the heel breast of a shoe.

FIGS. 9-10 shows a charm holder device 92 of a third embodiment. The shoe charm holder device 92 has an attachment portion 92*a* which attaches the shoe charm holder device 92 to the shoe 10; a shoe engaging portion 92*b* which is coupled to the attachment portion 92*a* and couples the charm engaging portion 92*c* to the shoe 10; and a charm engaging portion 92*c* for receiving charms or beads 44.

The attachment portion 92*a* is an attachment surface 102 that is directly attached to the outer sole 20 of the shoe. The attachment surface 102 may be fixedly attached to the outer sole 20 of the shoe 10 using an adhesive. Alternatively, the attachment surface 102 may be removably attached using a hook and loop fastener material, such as 3M® Dual Loop® Fastener or through magnets, where another magnet is placed underneath the insole 18 of the shoe 10 and the attachment surface 102 on the outer sole 20 of the shoe is magnetically attracted to the magnet underneath the insole 18 of the shoe. It should be noted that the adhesive, hook and loop fastener or the magnets need to be of sufficient strength to manage the weight of the shoe engaging portion 92*b* and the charm engaging portion 92*c* including any charms 44 and maintain the attachment of the shoe engaging portion 92*b* and the charm engaging portion 92*c* to the shoe 10.

Figure 14A:
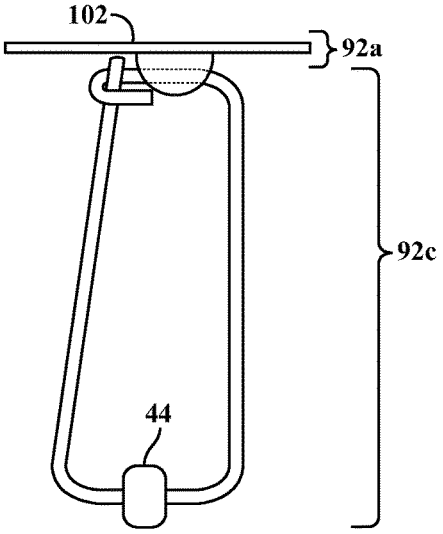
FIG. 14A shows another example of a shoe charm holder device design for attachment to the heel breast of a shoe in a first configuration.
Figure 14B:
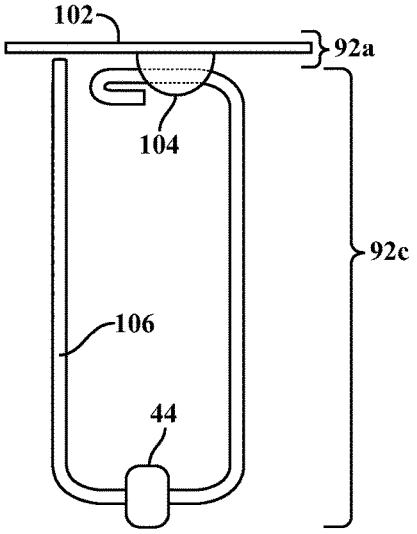
FIG. 14B shows the shoe charm holder device of FIG. 14A in a second configuration.

The shoe engaging portion 92*b* includes a nipple 104 for receiving a looped portion 108 for coupling to a charm keeper 106 of the charm engaging portion 92*c* for example as shown in FIGS. 14A-14B.

Figure 11:
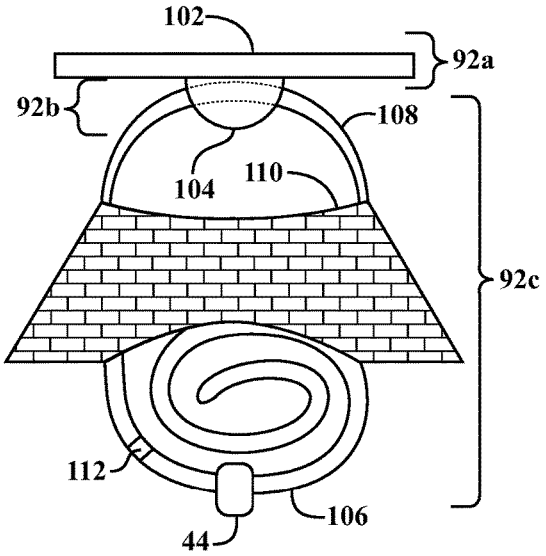
FIG. 11 shows another example of a shoe charm holder device design for attachment to the heel breast of a shoe.

The looped portion 108 may be coupled to the charm keeper 106 through a body 110 as shown in FIGS. 10 and 11. The body 110 may be of various shapes such as irregular polygons and skulls. The looped portion 108 may include a clasp that allows the looped portion to be removed from the nipple 104. The shoe engaging portion 92*b* is preferably fixedly attached to the attachment portion 92*a* through an adhesive or may be removably attached by magnets.

Figure 13:
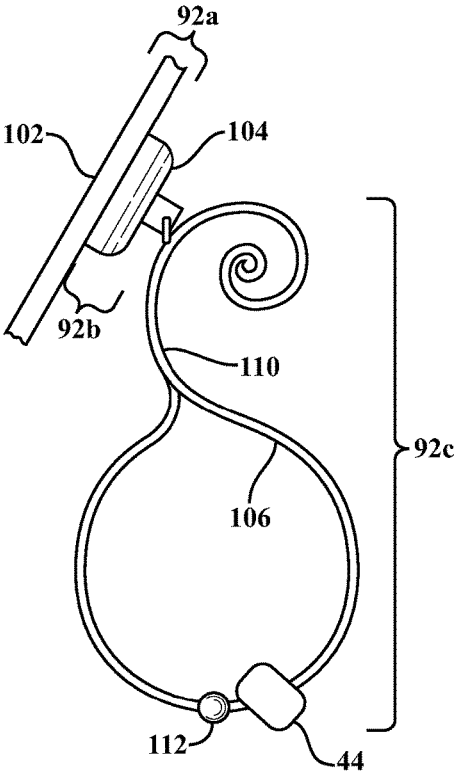
FIG. 13 shows another example of a shoe charm holder device design for attachment to the heel breast of a shoe.
Figure 15:
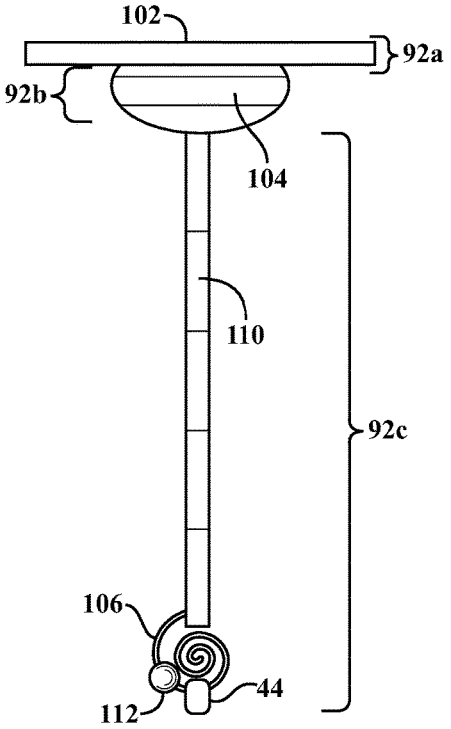
FIG. 15 shows another example of a shoe charm holder device design for attachment to the heel breast of a shoe.

Alternatively, shoe engaging portion 92*b* includes a nipple 104 which is directly attached to the body 110 of the charm engaging portion, for example as shown in FIGS. 13 and 15. In the example of FIG. 15, body 110 preferably has a telescoping structure that provides an adjustable length so that the wearer can alter the spacing between the shoe engaging portion 92*b* and the charm keeper 106 as desired.

Figure 12:
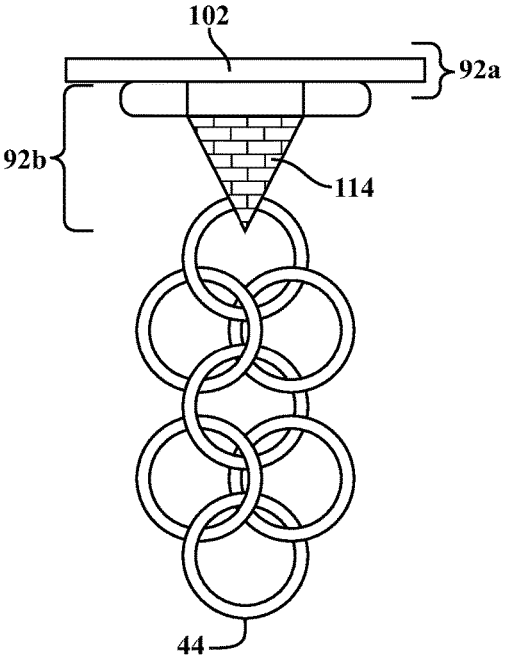
FIG. 12 shows another example of a shoe charm holder device design for attachment to the heel breast of a shoe.

In another embodiment, the shoe engaging portion 92*b* can include a triangular protrusion 114 which can be directly coupled to a charm 44, for example interconnected rings as shown in FIG. 12.

Figure 17:
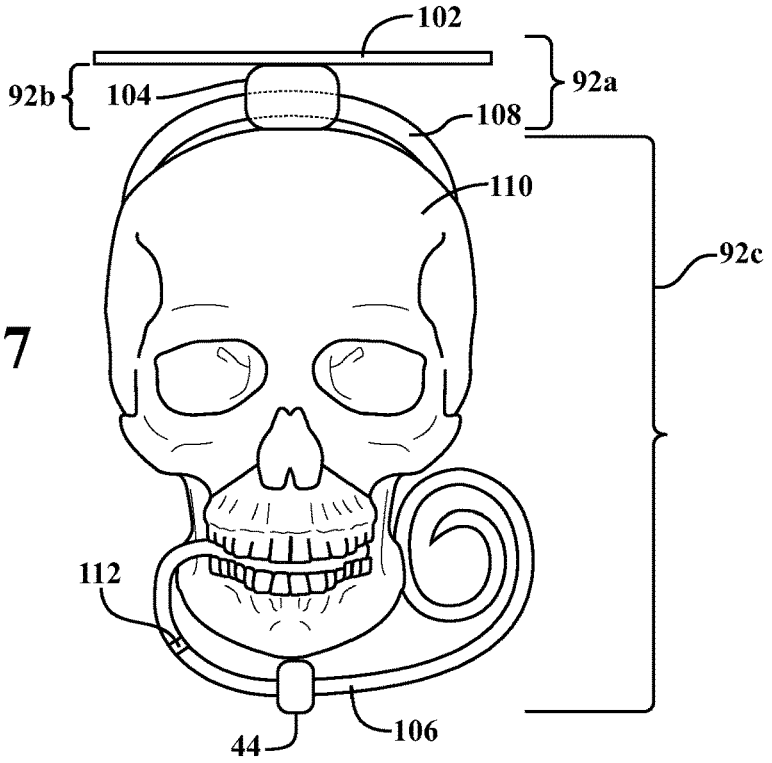
FIG. 17 shows another example of a shoe charm holder device design for attachment to the heel breast of a shoe.

In the charm holder devices of FIGS. 10-12, all or part of the body 110 is positioned between charm keeper 106 and shoe attachment portion 92*a* along a direction away from shoe attachment portion 92*a*. In FIGS. 10-12, the direction away from shoe attachment portion is perpendicular to the attachment surface 102 of shoe attachment portion 92*a*. The charm holder devices of FIGS. 17 and 18 are oriented similarly.

Figure 16:
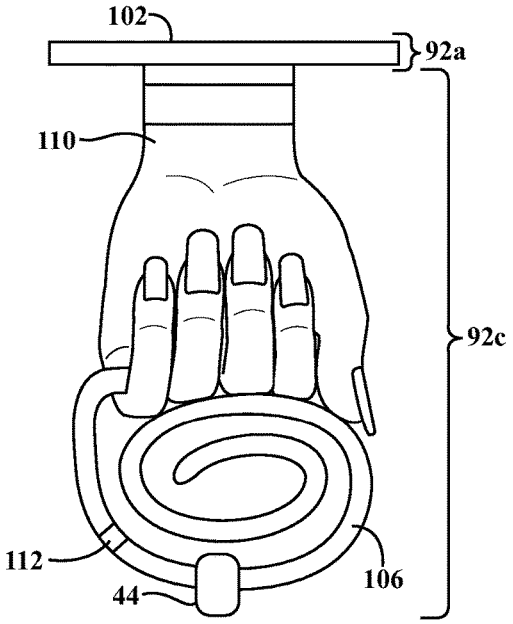
FIG. 16 shows another example of a shoe charm holder device design for attachment to the heel breast of a shoe.

In another embodiment, the body 110 of the charm engaging portion 92*c* can be directly connected to the attachment portion 92*a*, eliminating the shoe engaging portion 92*b*. The body may be hand shaped or oval shaped, for example, as shown in FIGS. 16 and 18, respectively.

The charm keeper 106 may include a hinge 112 which allows the charm keeper 106 to be moved from a first position in which charms or beads 44 may be added or removed from the charm keeper 106 to a second position in which charms or beads 44 are prevented from being removed or dislodged from the charm keeper 106.

Figure 18:
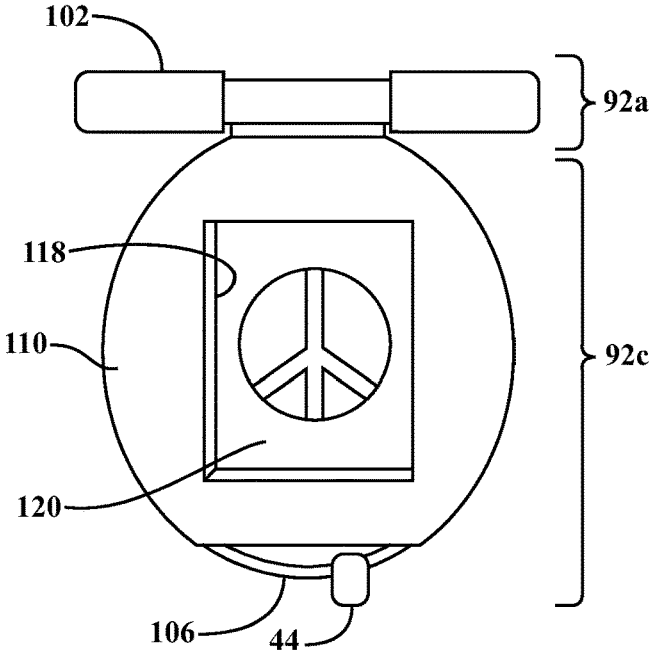
FIG. 18 shows another example of a shoe charm holder device design for attachment to the heel breast of a shoe.

Additionally, the body of the shoe charm holder device in any of the embodiments may have a cutout 118 for receiving decorative plates 120 as shown in FIG. 18.

The charms may be made of plastic, gold, silver, bronze, glass, nickel, or any other alloy.

It should be noted that the charms maybe of different lengths depending on the heel height of the shoe.

Furthermore, the charm or ornament 44 may be of any design that can be removably attached to the charm keeper and is not limited to any of the designs shown in the drawings.

While the shoes in FIGS. 1 and 9 are shown with an upper covering 22 of the toe region of a wearer's foot and a counter 24 to support the heel of a wearer, the shoe may alternatively just have straps on the toe region and/or around the heel.

In certain examples, the shoe 10 in which the shoe charm holder device is installed preferably has a heel that is at least 0.5 inches above the ground or greater and preferably includes, but is not limited to, kitten heels, high heels, and stilettos. However, as will be discussed further below, the charm holder device may also be installed on wedge shoes that have no heel shank or other appreciable clearance between the outsole and the ground.

Figure 19:
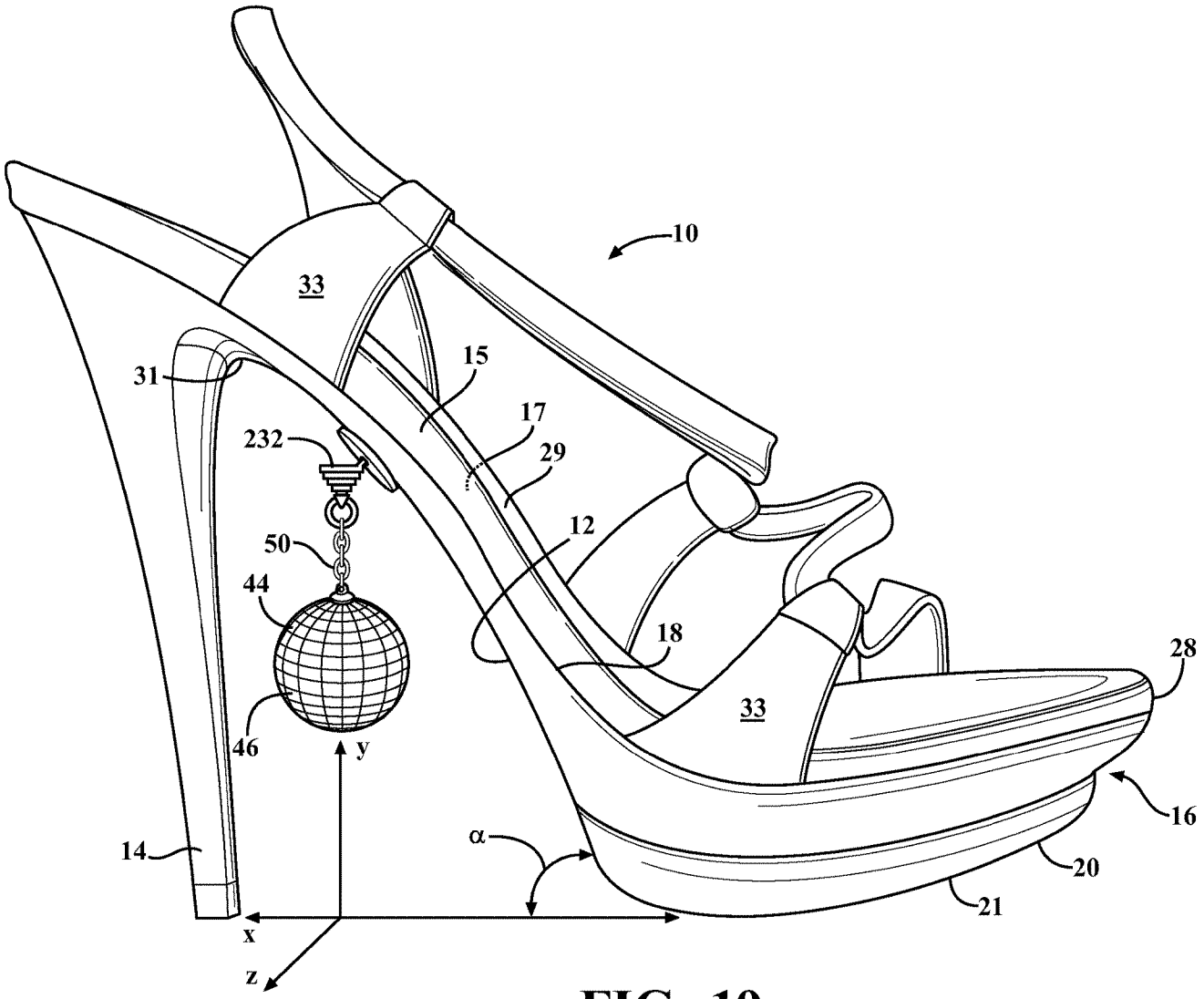
FIG. 19 is a side elevational view of a shoe comprising a charm holder device and a selectively detachable charm.
Figure 20:
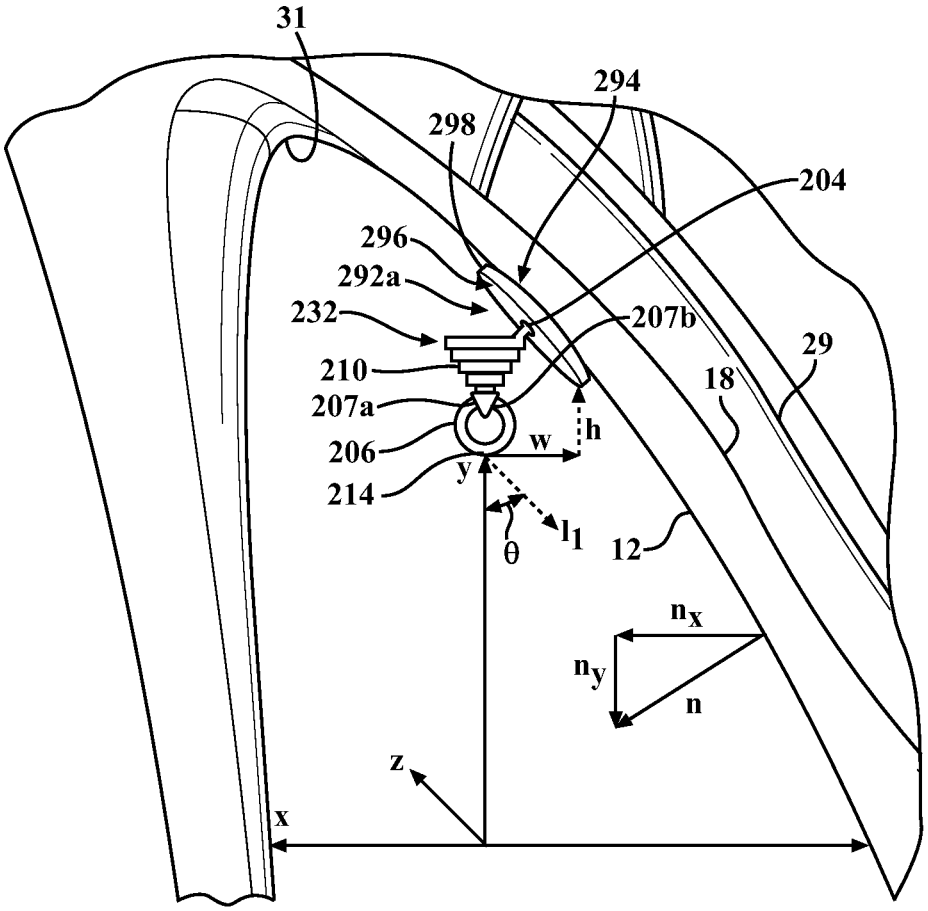
FIG. 20 is a close-up view of the charm holder device of FIG. 19.

Referring to FIG. 19, an alternate example of a shoe 10 comprising a charm holder device 232 is depicted. Like numerals refer to like parts depicted in the previous examples. Shoe 10 comprises heel 14 and toe end 28 which are spaced apart from one another along a first (length) direction of the shoe 10 which defines an x-axis. Shoe 10 also includes a lateral side 15 and a medial side 17. Shoe 10 also comprises an insole 18, an outsole 20 which includes a ground-contacting portion 21, a shank 12, and a heel breast 31. Shank 12 and heel breast 31 are located between ground-contacting portion 21 and heel 14 in a direction along the x-axis. In FIGS. 19 and 20, charm 44 includes a decorative object 46 in the shape of a sphere and a chain 50 that connects the decorative object 46 to the charm holder device 232. Shoe 10 further includes a sock insole lining 29 located on the insole 18. The sock insole lining 29 is in contact with the user's foot when the shoe 10 is worn. An upper 33 is also provided. A portion of the upper 33 which is not visible in the figures is located between the sock insole lining 29 and the insole 18 to hold the upper in place.

The ground-contacting portion 21 of outsole 20 and the charm holder device 232 are spaced apart in a second direction defining a second axis y. Lateral side 15 and medial side 17 of shoe 10 are spaced apart in a third direction defining a third axis z. Charm 44 is selectively detachable from and attachable to shoe 10 via charm holder device 232. In certain examples, and as shown in FIG. 19, charm 44 is capable of swinging movement relative to the charm holder device 232, heel 14, shank 12, and ground-contacting outsole portion 21. In other examples, charm 44 is capable of swinging along the x-axis, along the z-axis, and/or along directions having components along both the x-axis and the z-axis. As shown in FIG. 19, in certain preferred examples, charm 44 is spaced apart from the ground-contacting portion 21 of outsole 20 in the y-axis direction so that charm 44 does not drag along the ground during use. In certain examples, the bottom of the charm 44 extends no lower than half the distance between the outsole 20 and the ground at the heel 14. In the same or other examples, charm 44 is spaced apart from shank 12 in a first direction along the x-axis and is spaced apart from heel 14 in a second direction along the x-axis so that it can swing freely along the x-axis. Similarly, in the example of FIG. 19, charm holder device 232 is itself spaced apart from the ground-contacting portion 21 of outsole 20 in the y-axis direction and is located on the shank 12 of outsole 20.

Referring to FIG. 20, a close-up view of charm holder device 232 is provided. Charm holder device 232 comprises a shoe attachment portion 292*a*, a body 210, and a charm keeper 206. Body 210 may take a variety of polygonal, regular, or irregular three-dimensional shapes, but in preferred examples is a decorative ornament. In the specific example of FIGS. 19 and 20, body 210 is in the shape of a pyramid.

In the illustrated example body 210 is located between charm keeper 206 and shoe attachment portion 292*a* along a direction that projects away from shoe attachment portion 292*a*. The specific direction in FIG. 20 is the y-axis direction (i.e., the direction that is perpendicular to the ground-contacting portion 21 of outsole 20). In certain examples, body 210 may be selectively attachable to and detachable from shoe attachment portion 292*a*. However, in the particular example of FIGS. 19 and 20, body 210 is fixedly attached to shoe attachment portion 292*a*. Body 210 may be integrally formed with shoe attachment portion 292*a* to provide such fixed attachment. Alternatively, shoe attachment portion 292*a* and body 210 may be separately formed and then attached to one another.

In certain examples, charm holder device 232 is selectively attachable to and detachable from outsole 20 of shoe 10. In other examples, charm holder device 232 is fixedly attached to outsole 20 of shoe 10. In one selectively attachable and detachable example, shoe attachment portion 292*a* comprises a magnetic material and a complementary magnetic material is embedded between the inner sole 18 and outer sole 20 along shank 12 so that when shoe attachment portion 292*a* is placed in contact with outer sole 20, it is held to the out sole 20 by magnetic attraction to the complementary magnetic material. In other selectively attachable and detachable examples, shoe attachment portion 292*a* may be configured with a hook or loop fastener that is selectively attachable to a complementary hook or loop fastener affixed to outer sole 20.

Shoe attachment portion 292*a* is preferably a thin circular, triangular, or square shaped structure having a shoe contacting surface 294 that abuttingly engages the outsole 20 at a location between the sole ground-contacting portion 21 and the heel 14 in a direction along the x-axis. In general, shoe attachment portion 292*a* may be located at the shank 12 or the heel breast 31, but is shown located at shank 12 in FIGS. 19 and 20. However, as will be discussed further below, in certain examples the shoe attachment portion 292*a* may engage a surface of a shoe other than one along the outsole.

In the example of FIGS. 19 and 20, first shoe-contacting surface 294 of shoe attachment portion 292*a* is substantially planar. Shoe attachment portion 292*a* also includes a second surface 296 opposite the first surface 294. In the example of FIGS. 19 and 20, second surface 296 is also substantially planar. Shoe attachment portion 292*a* also has a thickness that defines a perimeter surface 298. In certain examples, including the example of FIGS. 19 and 20, the shoe-contacting surface 294 has a surface area, the perimeter surface 298 has a surface area, and the surface area of shoe contacting surface 294 is greater than the surface area of perimeter surface 298. In certain examples, the surface area of second surface 296 of shoe attachment portion 292*a* is also greater than the surface area of the perimeter surface 298. In general, increasing the surface area of contact between the outsole 20 along shank 12 and the first surface 294 at a given charm holder device 232 weight better ensures that the charm holder device 232 remains affixed to outsole 20. The first and second surfaces 294 and 296 of shoe attachment portion 292*a* may have a variety of shapes (when viewing surfaces 294 and 296 along a direction perpendicular to surfaces 294 and 296), including circles, ovals, squares, rectangles, and triangles. In certain preferred examples, the shape is selected from the group consisting of circles, squares, and rectangles. In the embodiment of FIGS. 19 and 20, each of the first and second surfaces 294 and 296 is in the shape of a circle when viewed along a direction perpendicular to first and second surfaces 294 and 296.

Charm keeper 206 is a closed loop in FIGS. 19 and 20. Charms with clasps that can be selectively opened and closed may be attached to charm keeper 206. In other embodiments, charm keeper 206 may be selectively opened and closed to receive a corresponding portion of a charm. Charm keeper 206 includes a distal-most point 214 (FIG. 20) which is the point spaced farthest from body 210 and a proximal-most point which is connected to or spaced closest to body 210. In FIG. 20, charm keeper 206 has two proximal-most points 207*a* and 207*b*, each of which is connected to body 210.

The surface of charm keeper 206 at distal-most point 214 lies in a plane that is tangent to charm keeper 206. The tangent plane is parallel to the x-z plane and has a normal (i.e., an axis that intersects it at a ninety degree angle) that is parallel to the y-axis. Thus an angle θ may be defined between the y-axis and a line $l_1$ lying in a plane (not shown) parallel to the substantially planar surface 294 of shoe attachment portion 292*a*. In the example of FIGS. 19 and 20, θ is an acute angle, which is preferable when shoe attachment portion 292*a* is attached to shank 12 because shank 12 defines an acute angle α (FIG. 19) with respect to the ground and ground-contacting portion 21 of outsole 20. In other examples, and in particular those in which shoe attachment portion 292*a* is attached to heel breast 31, the angle θ may be substantially 90 degrees as would be the case with the charm holder devices of FIGS. 10-12.

In certain examples, and as shown in FIGS. 19 and 20, the distal-most point 214 of charm keeper 206 is spaced apart from the shoe attachment portion 292*a* by a distance h (FIG. 20) in a direction perpendicular (normal) to the tangent plane in which distal-most point 214 of charm keeper 206 lies. In the same or other examples, distal-most point 214 is spaced apart from the shoe attachment portion 292*a* by a distance w in a direction parallel to the tangent plane. In the example of FIGS. 19 and 20, the distal-most point 214 is spaced apart from the shoe attachment portion 292*a* by a distance h in the direction normal to the tangent plane in which distal-most point 214 lies and by a distance w in the direction parallel to the tangent plane. In addition, in the illustrated example, w is greater than h.

Second surface 296 of shoe attachment portion 292*a* may be characterized as having a central portion surrounded by a border portion. In certain examples, and as best seen in FIG. 20, body 210 is connected to second surface 296 at a central portion of second surface 296. In the case of FIGS. 19 and 20, body 210 is preferably connected to shoe attachment portion 292*a* at or substantially at the radial center of second surface 296. Body 210 is connected to shoe attachment portion 292*a* at a connection point 204. In certain examples, a shoe engaging portion such as the shoe engaging portions 92*b* of FIGS. 10-13 may also be provided to connect body 210 to shoe attachment portion 292*a*. The connection at connection point 204 may be made by soldering, welding, adhesive, mechanical fastening, etc.

In certain examples, including the example of FIGS. 19 and 20, body 210 has an axis of symmetry that is substantially perpendicular to the tangent plane in which distal-most point 214 of charm keeper 206 lies. This structure is also depicted in FIGS. 10 and 11. Body 210 is preferably a decorative ornament, and in FIGS. 19 and 20 is a pyramid. In certain examples, body 210 is selectively attachable to and detachable from shoe attachment portion 292*a*. However, in other examples (including FIGS. 19 and 20), body 210 is fixedly attached to shoe attachment portion 292*a*.

Figure 21:
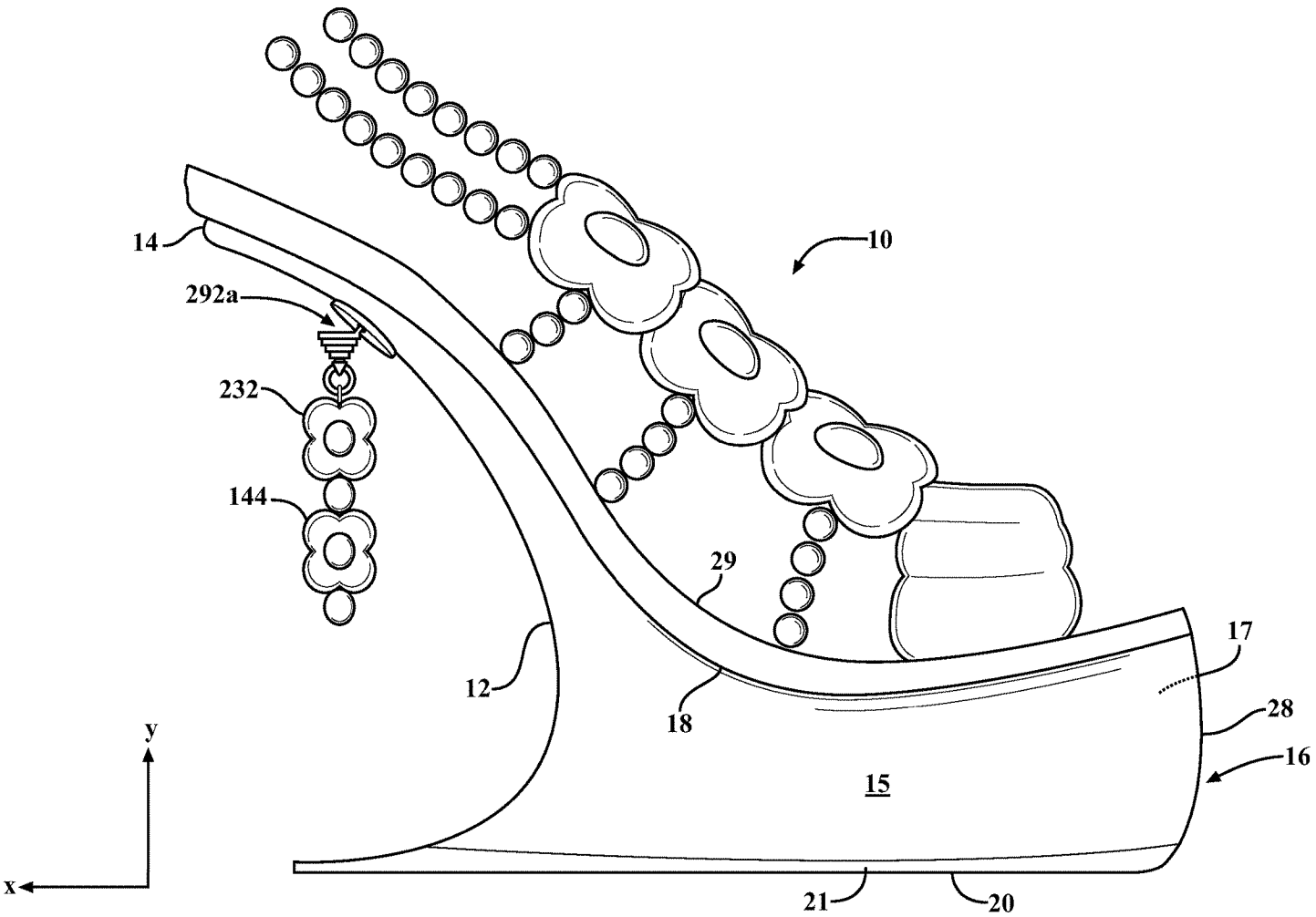
FIG. 21 is a side elevational view of a shoe comprising a charm holder device and a selectively detachable charm in which the heel does not contact the ground.

Referring to FIG. 21, another embodiment of a shoe 10 comprising a charm holder device 232 is depicted. In this embodiment, shoe 10 has a heel 14 that does not contact the ground. Shoe 10 includes a heel shank 12 between heel 14 and ground-contacting portion 21 of outsole 20 in a direction along the x-axis. In some cases, the shoe 10 of FIG. 21 may be referred to as a "heel-less" shoe because there is no ground contacting portion of the shoe beneath (in the y-axis direction) the location where the heel of the foot is positioned. However, for purposes of FIG. 21 the portion of shoe 10 spaced furthest from the toe section 28 in a direction along the x-axis may be referred to as a heel 14. Charm holder device 232 is substantially identical to the charm holder device of FIGS. 19-20. However, charm 144 on the shoe 10 of FIG. 21 is different than the charm 45 of FIG. 19.

Figure 22:
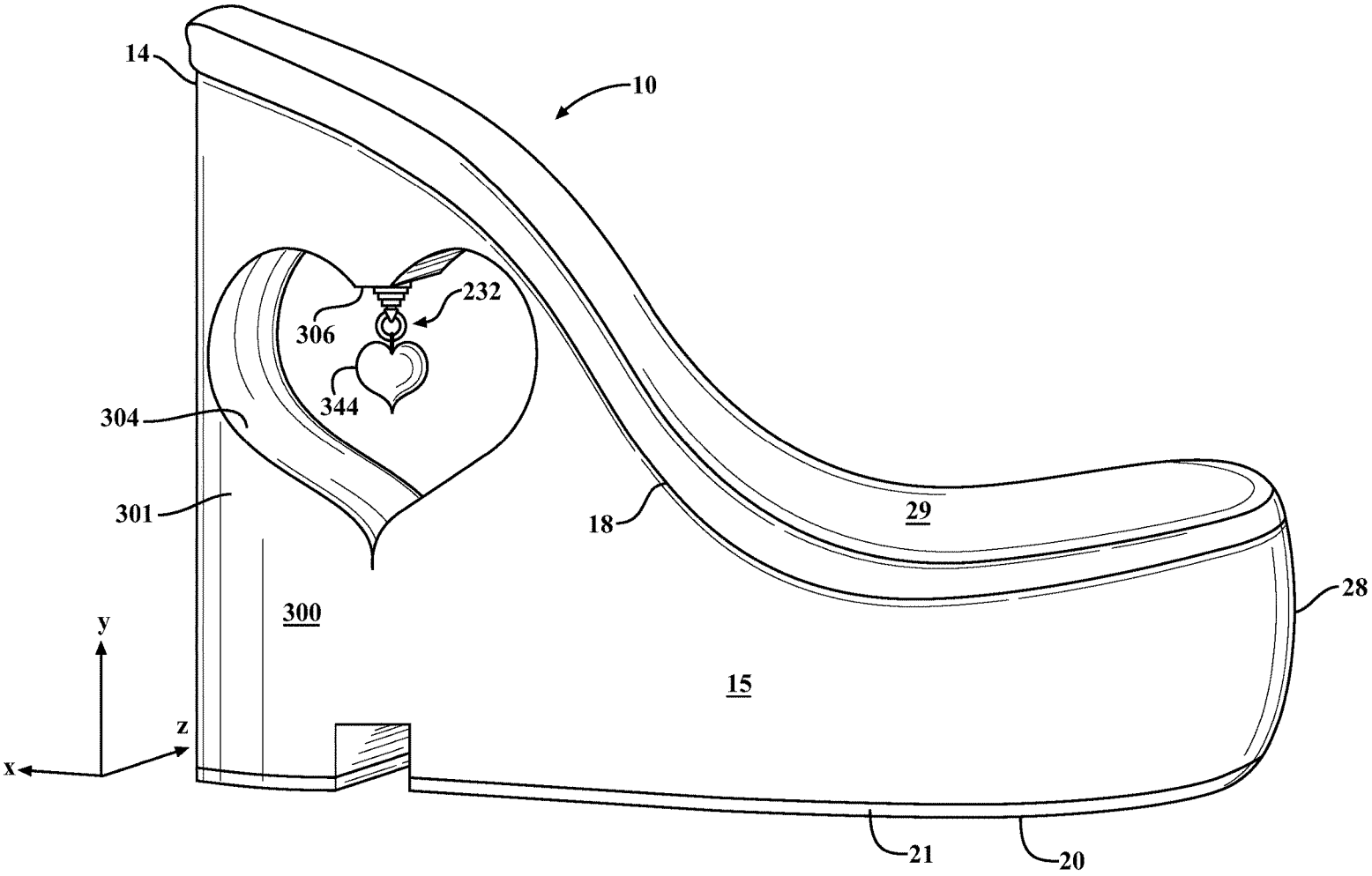
FIG. 22 is a side elevational view of a wedge shoe (with the vamp omitted) comprising a charm holder attached within a cut-out portion of the shoe.

Referring to FIG. 22, a further embodiment of a shoe 10 comprising a charm holder device 232 connected to charm 344 is depicted. The shoe 10 of FIG. 22 is a wedge shoe (shown with the vamp omitted) and does not include a heel shank that provides sufficient clearance to the ground to allow for the attachment of charm holder device 232. Charm holder device 232 is configured similarly to charm holder device 232 of FIGS. 19-20. In this example, a cut-out region 301 is formed which extends from the surface 300 of lateral side 15 to the opposing surface 302 (not shown) of medial side 17 (not shown) of shoe 10. Cut-out region 301 includes an inner surface 304 in the interior of the cut-out region 301.

Inner surface 304 includes a downward-facing portion 306 that faces in the direction of ground-contacting portion 21 of outsole 20 (i.e., downward-facing portion 306 is substantially parallel to the x-z plane). The shoe attachment portion 292*a* (not separately shown in FIG. 22) of charm holder device 232 is attached to the downward-facing portion 306 of cut-out region 301. In this example, the surfaces 294 and 296 (not shown) of the shoe attachment portion 292*a* are generally parallel to the ground-contacting portion 21 of outsole 20 and to the x-z plane. However, the cut-out region 301 could include sloped sidewalls, in which case the shoe attachment portion 292*a* could be oriented at an angle with respect to ground-contacting portion 21 of outsole 20 as is the case in FIGS. 19 and 20. Thus, in the example of FIG. 22, charm 344 is swingable along both the x and z axis directions relative to outsole 20 and relative to charm holder device 232.

The charm holder devices 32, 232 described herein may be made of plastic, metal, or any other substantially rigid material. However, in preferred examples, the charm holder devices 32, 232 include an outer surface with a metallic appearance. In certain examples, the outer surface comprises a non-tarnishing material. In the same or other examples, the outer surface has a shiny appearance. In one example, charm holder devices 32, 232 are formed from a brass base material covered with a rhodium plating. In another example, the charm holder devices 32, 232 are formed from a brass base material covered with a gold plating. In one example where a rhodium plating is used, the plating is silver and white in color.

As mentioned previously, charm holder devices 32, 232 may be affixed to shoe 10 or selectively attachable to and detachable from it. In those examples where the charm holder devices are fixedly attached, the fixed attachment may be provided by mechanical or adhesive means. In fixed attachment examples wherein the shoe attachment portion 292*a* is attached to a rubber, plastic, or fabric material on shoe 10, adhesive attachment is preferable. In one example, a neoprene adhesive containing polychloroprene rubber is used. One such suitable adhesive is a Dual #88 Super Strength All Purpose Cement supplied by R-H Products, Co., Inc. of Acton, Mass. Other suitable adhesives include cyanoacrylate adhesives, one example of which is an ethyl cyanoacrylate adhesive sold under the name Gorilla Super Glue by the Gorilla Glue Company of Cincinnati, Ohio.

The charm holder devices 32, 232, and 332 (described below) may be applied to different shoes and at different shoe locations than those described previously. In general, the surface of the shoe to which the charm holder device 32, 232 is attached will preferably have a surface normal (i.e., axis perpendicular to the surface) that is not parallel to the ground-contacting portion 21 of outsole 20. The surface normal preferably comprises a component that is perpendicular to the ground contacting portion 21 of the shoe. In other words, the surface normal is the vector sum of two component vectors, one of which is perpendicular to ground-contacting portion 21. For example, in FIGS. 19 and 20, shoe attachment portion 292*a* of charm holder device 232 is attached to the heel shank 12. The heel shank 12 has a surface normal vector n that can be resolved into two component vectors, one of which is parallel to the y-axis ($n_y$), and the other of which is parallel to the x-axis ($n_x$). The vector parallel to the y-axis ($n_y$) is perpendicular to ground-contacting portion 21 of outsole 20. This orientation allows the charm attached to the charm holder device 32, 232 to hang freely and swing, at least to some extent.

Figure 23A:
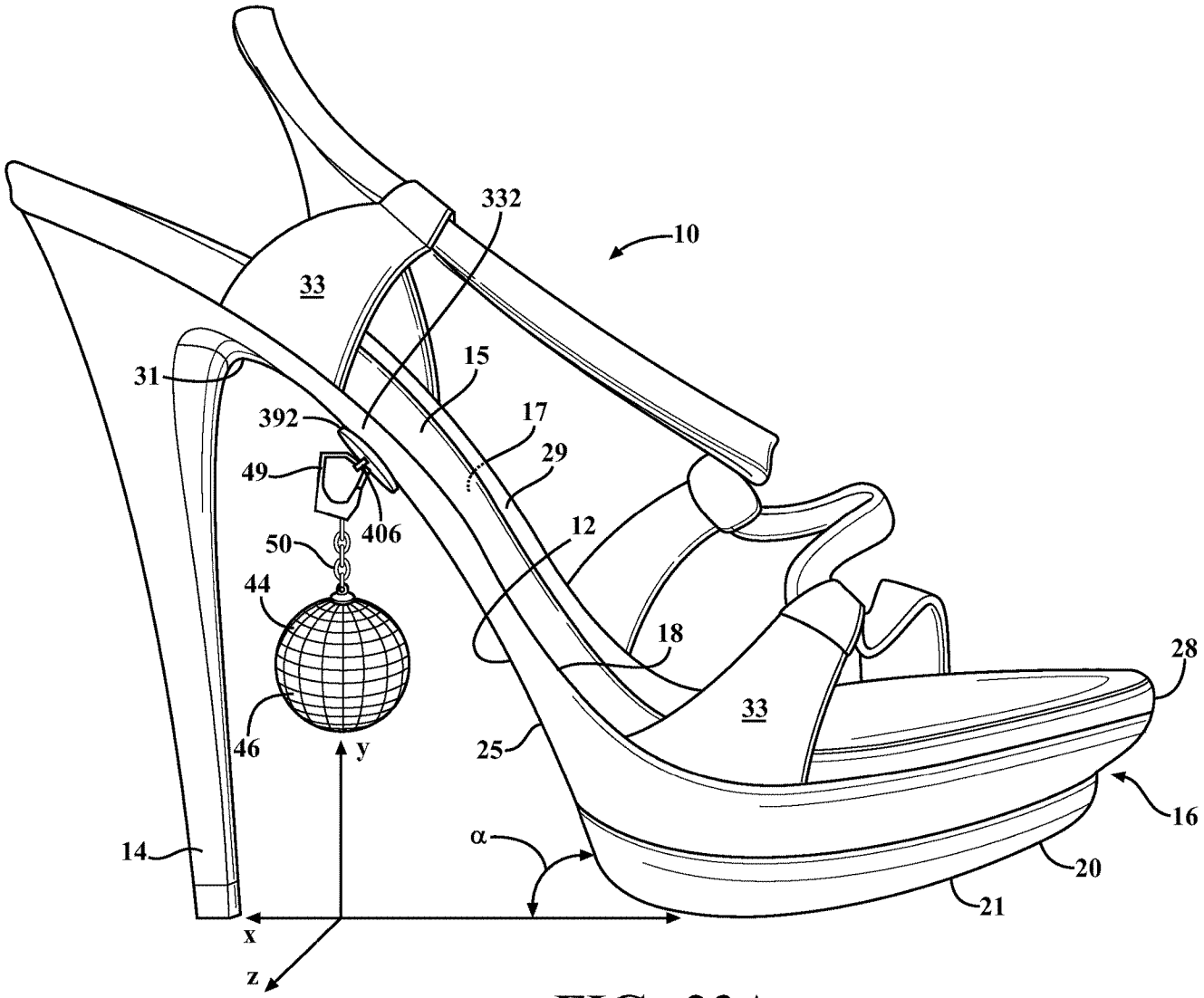
FIG. 23*a* is a side elevational view of a shoe with another exemplary charm holder device attached to the outsole of the shoe and a selectively detachable charm attached to the charm holder device.
Figure 23B:
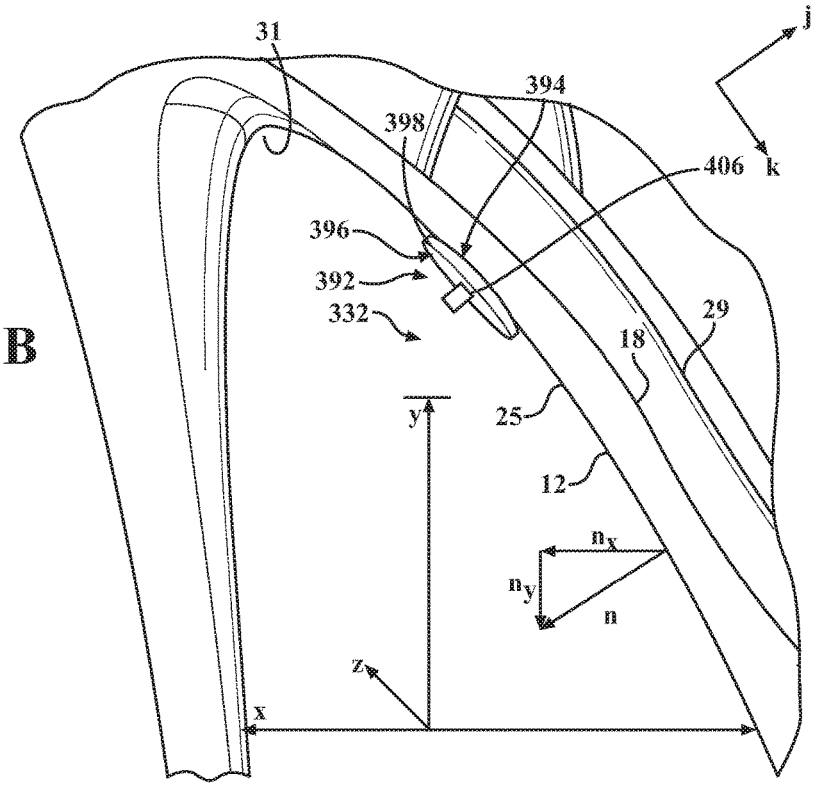
FIG. 23*b* is a close-up side elevational view of the shoe of FIG. 23*a* with the charm removed from the charm holder device.

Referring to FIG. 23*a*, shoe 10 is depicted with another example of a charm holder device 332 to which selectively detachable charm 44 is attached. The elements of shoe 10 are the same as those depicted in FIGS. 19-20 except for the charm holder device 332. Charm holder device 332 may be used with other shoe styles as well, including shoes that lack a heel such as the shoe 10 depicted in FIG. 21.

In the example of FIG. 23*a*, shoe 10 comprises a charm holder device 332 attached to a portion of the shoe 10. In FIG. 23*a*, charm holder device 332 is attached to the outsole 20 at a location that is spaced apart from the ground-contacting portion 21 of outsole 20 along both the x-axis and the y-axis. In the depicted example, the charm holder device 332 is located between the heel 14 and ground-contacting outsole portion 21 along the length axis of the shoe, which is the x-axis in FIG. 23*a*. Any style of charm may be used. To illustrate the operation of the charm holder device 332, charm 44 is depicted. Charm 44 comprises a decorative object 46 in the shape of s sphere, a chain 50, and a clasp 49. The chain 50 is connected to the decorative object 46 at a first end and to clasp 49 at a second end. The clasp 49 is selectively openable and closable. When clasp 49 is in an open configuration, it is engageable with charm keeper 406. Once engaged, the clasp 49 can be adjusted to a closed configuration for secure retention to charm keeper 406. In FIGS. 23*a*-26, the orientations of the components of shoe 10 relative to one another are defined using x, y, and z axes, while the orientations of the components of the charm holder device 332 relative to one another are defined using i, j, and k axes. Once the charm holder device 332 is installed on a shoe, the two coordinate systems (x, y, z) and (i, j, k) will have a fixed relationship to one another. In general, the charm holder device 332 may be located at the shank 12 or the heel breast 31, but is located at shank 12 in FIGS. 23*a* and 23*b*.

In the example of FIG. 23*a*, the surface of outsole 20 at which the charm holder device 332 is located has a surface normal n that is not parallel to the ground-contacting surface 21 of outsole 20, and thus, is not perpendicular to a surface normal to the ground-contacting surface 21. As illustrated, the surface normal to the portion of the outsole at which the charm holder device 332 is located is also not parallel to the surface normal to the ground-contacting surface 21 of outsole 20. In the example of FIG. 23*a*, charm 44 can swing freely along the lateral to medial (or width) axis of the shoe 10, which is depicted as the z-axis as well as along the shoe length axis (x-axis). However, charms may be attached to the charm holder device 332 which would not swing along either or both of the x and y axes.

Figure 24:
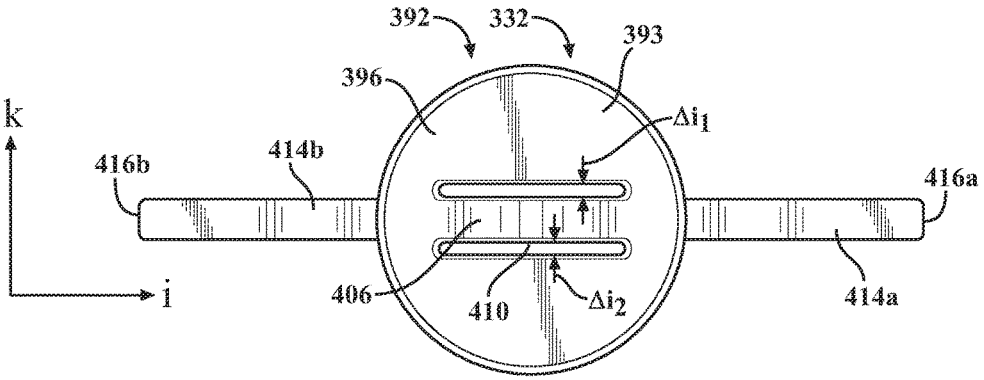
FIG. 24 is a bottom plan view of the charm holder device of FIG. 23*a;*
Figure 25A:
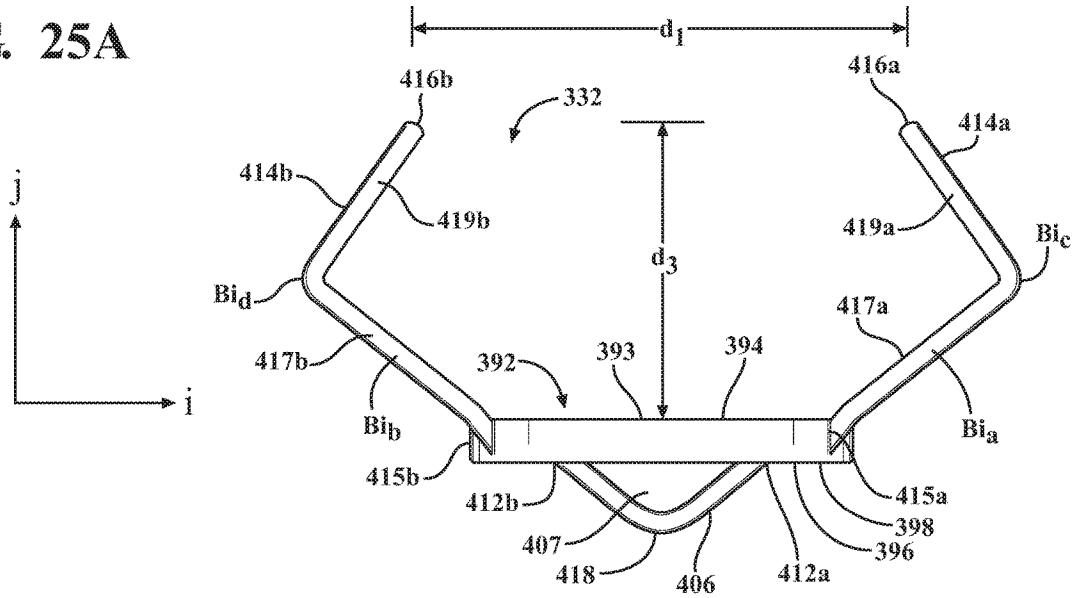
FIG. 25*a* is a side elevational view of the charm holder device of FIG. 23*a* with the first and second stakes in a first configuration.
Figure 25B:
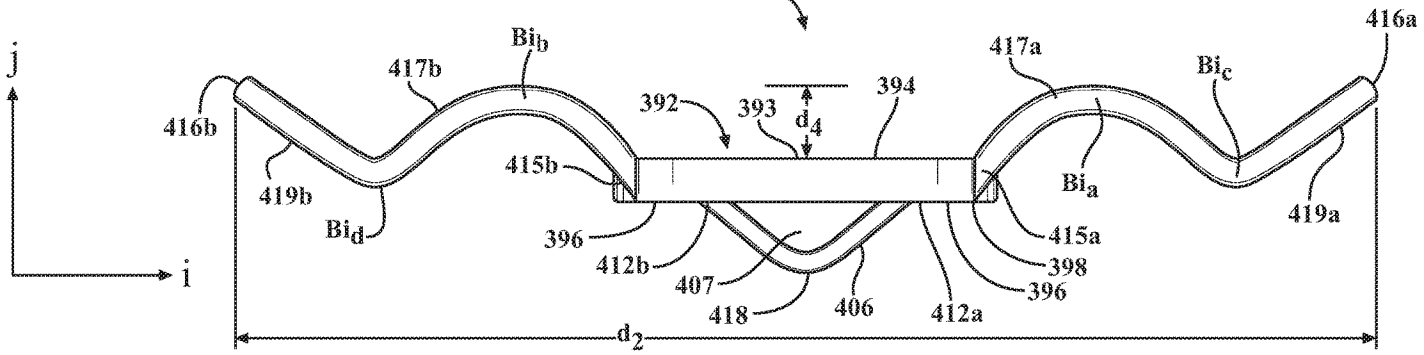
FIG. 25*b* is a side elevational view of the charm holder device of FIG. 23*a* with the first and second stakes in a second configuration.

Referring now to FIG. 24, the charm holder device 332 of FIG. 23*a* is shown in greater detail in a bottom plan view. Charm holder device 332 comprises a shoe engaging portion 392 and a charm keeper 406. The shoe engaging portion 392 comprises a base plate 393, a first stake 414*a*, and a second stake 414*b*. The first stake and second stake each comprise respective first ends 415*a* and 415*b* (FIGS. 25*a*, 25*b*) which are each attached to the base plate 393 and respective second ends 416*a* and 416*b* which are spaced apart from the base plate 393. The respective first ends 415*a* and 415*b* of stakes 414*a* and 414*b* are spaced apart from one another along the i axis (FIGS. 25*a*, 25*b*). While the stakes 414*a* and 414*b* are depicted in FIGS. 24 and 25*a* as comprising linear segments 417*a*/419*a* and 417*b*/419*b* that have an unvarying width along the i axis, other stake shapes may be used including those with variable i axis widths. Base plate 393 comprises an upper surface 394, a lower surface 396, and a side surface 398 that defines the perimeter of the base plate 393. Base plate 393 has a circular profile when viewed along the j axis in FIG. 24. However, other profiles such as squares, rectangles, triangles, and irregular shapes may also be used. The upper and lower base plate surfaces 394 and 396 may have the same or different profiles.

In certain examples, base plate 393 is dimensioned so that its longest dimension is shorter than the spacing along outsole 20 between the lateral side 15 and medial side 17 (i.e., along the z-axis) of a shoe. The total linear lengths of the stakes 414*a* and 414*b* (i.e., the sum of the lengths of first region 417*a* and second region 419*a* for stake 414*a* and the sum of the lengths of first region 417*b* and second region 419*b* for stake 414*b*) are preferably greater than the thickness between the outsole 20 and the insole 18 and preferably less than the distance along the outsole 20 from the lateral side 15 to the medial side 17 of the shoe 10 at the location on the outsole 20 where the charm holder device 332 is placed.

In the example of FIGS. 25*a* and 25*b*, the respective first ends 415*a* and 415*b* of the first and second stakes 414*a* and 414*b* are attached to an upper surface 394 of the base plate 393. A charm keeper 406 is also attached to the base plate 393 and projects away from the base plate 393 in a direction along the j axis. Thus, the respective first ends 415*a* and 415*b* of the stakes 414*a* and 414*b* are spaced apart from the charm keeper 406 along the j axis. In the example of FIGS. 24*a*-25*b*, the first ends 415*a* and 415*b* of first and stakes 414*a* and 414*b* are not spaced apart from one another along the i axis. However, in certain examples, they may be.

The charm holder device 332 is adjustable between multiple configurations that define unique geometric relationships between the stakes 414*a* and 414*b* and the base plate 393. Two such configurations are depicted in FIGS. 25*a* and 25*b*. In the first configuration of FIG. 25*a*, the first and second stakes 414*a* and 414*b* are in a first configuration in which their respective second ends 416*a* and 416*b* are spaced apart from the base plate 393 by a first distance $d_3$ (or respective first distances) along the j axis. In the second configuration of FIG. 25*b*, the first and second stakes 414*a* and 414*b* are in a second configuration in which their respective second ends 416*a* and 416*b* are spaced apart from the base plate 393 by a second distance $d_4$ (or respective second distances) along the j axis, wherein the first distance is greater than the second distance.

As illustrated in FIGS. 25*a* and 25*b*, in certain examples, in the first configuration (FIG. 25*a*), the respective second ends 416*a* and 416*b* of the stakes 414*a* and 414*b* are spaced apart from one another along the i axis by a first distance $d_1$, and in the second configuration (FIG. 25*b*), the respective second ends 416*a* and 416*b* are spaced apart from one another along the i axis by a second distance $d_2$, and the second distance is greater than the first distance.

To allow the first and second stakes 414*a* and 414*b* to be adjusted between the first and second configurations, the first stake 414*a* is bendable about a first bending axis $B_{ia}$ that is parallel to the k axis. The second stake 414*b* is bendable about a second bending axis $B_{ib}$ that is also parallel to the k axis. The two bending axes $B_{ia}$ and $B_{ib}$ are spaced apart from one another along the i axis. In certain examples, the bending axes $B_{ia}$ and $B_{ib}$ are spaced apart from the upper surface 394 of the base plate 393 by a distance $d_4$ (or respective distances) along the j axis. The first stake 414*a* and second stake 414*b* are preferably bendable about their respective bending axes $B_{ia}$ and $B_{ib}$ using manual pressure without the assistance of any tools. In preferred examples, the materials of construction of the stakes 414*a* and 414*b* and the dimensions of thestakes 414*a* and 414*b* are selected to make the stakes 414*a* and 414*b* bendable about their respective first bending axes $B_{ia}$ and $B_{ib}$. In one example, the stakes 414*a* and 414*b* have thicknesses along the j axis that are preferably no greater than about 2 mm, more preferably no greater than about 1.5 mm, and still more preferably no greater than about 1.0 mm. In the same or other examples, the thicknesses along the j axis are preferably at least about 0.3 mm, more preferably at least about 0.4 mm, and still more preferably at least about 0.6 mm. In the same or other examples, the stakes 414*a* and 414*b* have a width along the k axis direction that is no greater than about 4 mm, preferably no greater than about 2 mm, and still more preferably no greater than about 1.5 mm. In the same or other examples, the widths along the k axis are preferably no less than about 0.5 mm, more preferably no less than about 0.6 mm, and still more preferably no less than about 0.8 mm.

In the same or other examples, the total linear lengths of each of the stakes 414*a* and 414*b* (i.e., the lengths if the stakes 414*a* and 414*b* were completely flat) are preferably no more than about 20 mm, more preferably no more than about 15 mm, and still more preferably no more than about 12 mm. In the same or other examples, the total linear lengths are preferably at least about 5 mm, more preferably at least about 6 mm, and still more preferably at least about 8 mm.

In certain examples, and as shown in FIGS. 25*a* and 25*b*, the first and second stakes 414*a* and 414*b* are also bendable about second respective bending axes $Bi_c$ and $Bi_d$. The first bending axis $Bi_c$ divides first stake 414*a* and into a first region 417*a* and a second region 419*a*, wherein the first region 417*a* is disposed between the second region 419*a* and the base plate 393. The second bending axis $Bi_d$ divides second stake 414*b* into a first region 417*b* and a second region 419*b* wherein the first region 417*b* is disposed between the second region 419*b* and the base plate 393. Bending axis $Bi_c$ and $Bi_d$ are parallel to one another and are also parallel to the first bending axes $Bi_a$ and $Bi_b$.

Bending each stake 414*a* and 414*b* about its respective second bending axis $Bi_c$ and $Bi_d$ changes the angle defined between each stake's respective first and second regions. Thus, bending stake 414*a* about bending axis $Bi_c$ alters the angle between first region 417*a* and second region 419*a* of first stake 414*a*. Correspondingly, bending stake 414*b* about bending axis $Bi_d$ alters the angle between first region 417*b* and second region 419*b* of second stake 414*b*. Bending the stakes 414*a* and 414*b* about their respective second bending axes $Bi_c$ and $Bi_d$ also allows the distance between each stake's second end 416*a* and 416*b* and corresponding first end 415*a* and 415*b* to be adjusted. For example, if the charm holder device 332 is in the configuration of FIG. 25*a* and the stakes 414*a* and 414*b* are bent about their respective second bending axes $Bi_c$ and $Bi_d$ without also bending the stakes about their respective first bending axis $Bi_a$ and $Bi_b$, the spacing between each stake's second end 416*a* and 416*b* and corresponding first end 415*a* and 415*b* will be altered. However, the angles defined between each stake's first region 417*a* and 417*b* and the base plate 393 will not be altered. While the stakes 414*a* and 414*b* may be manufactured with the distal ends 416*a* and 416*b* projecting inwardly toward one another along the x-axis for ease of packaging, they need not be. In certain examples, the charm holder device 332 is provided in an initial configuration prior to installation on shoe 10 in which the stakes 414*a* and 414*b* are substantially straight, and may or may not be oriented perpendicularly to upper surface 394 of base plate 393.

Charm holder device 332 also includes a charm keeper 406 attached to the shoe engaging portion 392. In the example of FIGS. 24-25*b*, the charm keeper is attached to lower surface 396 of base plate 393. Charm keeper 406 is shaped to receive and engage a portion of a charm, such as a loop or a selectively openable and closeable clasp. In the example of FIGS. 24-25*b*, the charm keeper 406 is affixed to the base plate 393 and cannot be opened or closed. However, in other examples, charm keeper 406 may be selectively opened and closed to receive and engage charms.

In the example of FIGS. 24-25*b*, the charm keeper 406 comprises a member having a first end 412*a* and a second end 412*b* which are attached to locations on base plate 393 that are spaced apart from one another along the k axis. In the depicted example, the locations on base plate 393 to which the first and second ends 412*a* and 412*b* of the charm keeper 406 are attached are not spaced apart from one another along either the i axis or the j axis. However, in certain examples, they may be spaced apart along either or both the i and j axes. In the depicted example, the charm keeper 406 has a length along the k axis and a width along the i axis, wherein the length is greater than the width. Thus, as depicted, the length axis of the charm keeper 406 is parallel to the axis defined by the spacing between the first stake ends 415*a* and 415*b*. However, the two axes may be perpendicular to one another or oriented at non-orthogonal angles relative to one another.

Charm keeper 406 preferably projects away from the base plate 393, and more preferably, projects away from the base plate 393 and away from the respective first ends 415*a* and 415*b* of stakes 414*a* and 414*b* in a direction along the j axis. As a result, when viewed along the i axis (FIGS. 25*a*, 25*b*), charm keeper 406 defines an opening 407 between the charm keeper 406 and the base plate 393. The opening 407 provides a location for inserting a component of a charm to engage the charm to the charm keeper 406. For example, hooks or clasps may be inserted through opening 407 to retain a charm to the charm keeper 406.

In the example of FIGS. 24-25*b*, charm keeper 406 includes a peak 418 between the charm keeper first end 412*a* and second end 412*b*. The peak 418 is spaced apart from the base plate 393 along the j axis and is the location of maximum spacing between the charm keeper 406 and the base plate 393 along the j axis. In certain examples, the peak 418 is spaced apart from each of the charm keeper ends 412*a* and 412*b* by the same or substantially same distance along the k axis.

In certain examples, the charm holder device 332 is designed to provide additional space along the j axis to receive a charm. As best seen in FIG. 24, the base plate 393 includes an opening 410 that extends through the upper surface 394 and the lower surface 396 of the base plate 393. The opening 410 has a length along the k axis and a width along the i axis, wherein the length is greater than the width. As best seen in FIG. 24, in certain preferred examples, the width of opening 410 along the i axis is greater than the width of the charm keeper 406 along the i axis. The portion of a charm that engages the charm keeper 406 will generally have a width that is no less than the width of the charm keeper 406 along the i axis to ensure secure retention of the charm. When the charm is engaged to the charm keeper 406, the portion of the charm engaging the charm keeper 406 may also have a height above the charm keeper 406 along the j axis. Thus, providing opening 410 with an i axis width greater than the i axis width of the charm keeper 406 allows the portion of the charm that engages the charm keeper 406 to fit into the additional j axis space created by opening 410. Otherwise, the maximum j axis spacing available for a charm to engage the charm keeper 406 would be defined by the j axis distance between the lower surface 396 of base plate 393 and the peak 418 of the charm keeper 406. Instead, when opening 410 is provided, the maximum j axis spacing available for a charm to engage the charm keeper 406 is defined by the distance between the outsole 20 (FIGS. 23*a*-23*b*) of the shoe and the charm keeper peak 418.

In the example of FIG. 24, the width of opening 410 along the i axis defines first and second i axis clearances $\Delta i_1$ and $\Delta i_2$ which may be same or different from one another, but which are substantially equal in FIG. 24. In the example of FIG. 24, the k axis length and i axis width of opening 410 are positioned symmetrically about the center of the base plate 393 in the i-k plane. However, in other examples, asymmetrical configurations may be provided. As illustrated in FIG. 24, the length of the opening 410 along the k axis is the same or substantially the same as the length of the charm keeper 406 along the k axis, but in other examples, the two lengths may differ.

The charm holder device 332 may be formed from a variety of different materials, including plastics and metals. In preferred example, the charm holder device 332 is formed from a material or materials that will not wear or tarnish despite prolonged use on the sole of the shoe during which the charm holder device 332 is exposed to the elements.

In one example, at least one of the base plate 393, charm keeper 406, and first and second stakes 414*a* and 414*b* comprises metal materials. In another example, each of the base plate 393, charm keeper 406, and first and second stakes 414*a* and 414*b* comprises metal materials. In yet another example, at least one of the base plate 393, charm keeper 406, and first and second stakes 414*a* and 414*b* consists essentially of metal materials. In still another example, each of the base plate 393, charm keeper 406, and first and second stakes 414*a* and 414*b* consists essentially of metal materials. In another example, each of the base plate 393, charm keeper 406, and first and second stakes 414*a* and 414*b* comprises the same metal material. In further examples, each of base plate 393, charm keeper 406, and first and second stakes 414*a* and 414*b* consists essentially of the same metal material. In the example shown in FIGS. 24-25*b*, each of the base plate 393, charm keeper 406, and first and second stakes 414*a* and 414*b* consists essentially of nickel. In other examples, each of the base plate 393, charm keeper 406, and first and second stakes 414*a* and 414*b* consists essentially of a brass base material covered with rhodium.

A variety of different techniques may be used to form the charm holder device 332. In one example, the base plate 393 and charm keeper 406 are cast out of a metal, preferably nickel, to integrally form a portion of the charm holder device 332 comprising the base plate 393 and charm keeper 406. The stakes 414*a* and 414*b* are separately cast and then attached to the base plate 393 such as by welding or soldering in a manner that makes the stakes 414*a* and 414*b* bendable about their respective first bending axes $Bi_a$ and $Bi_b$. In another example, the entire charm holder device 332 is integrally formed as a single piece, such as by casting.

Figure 26:
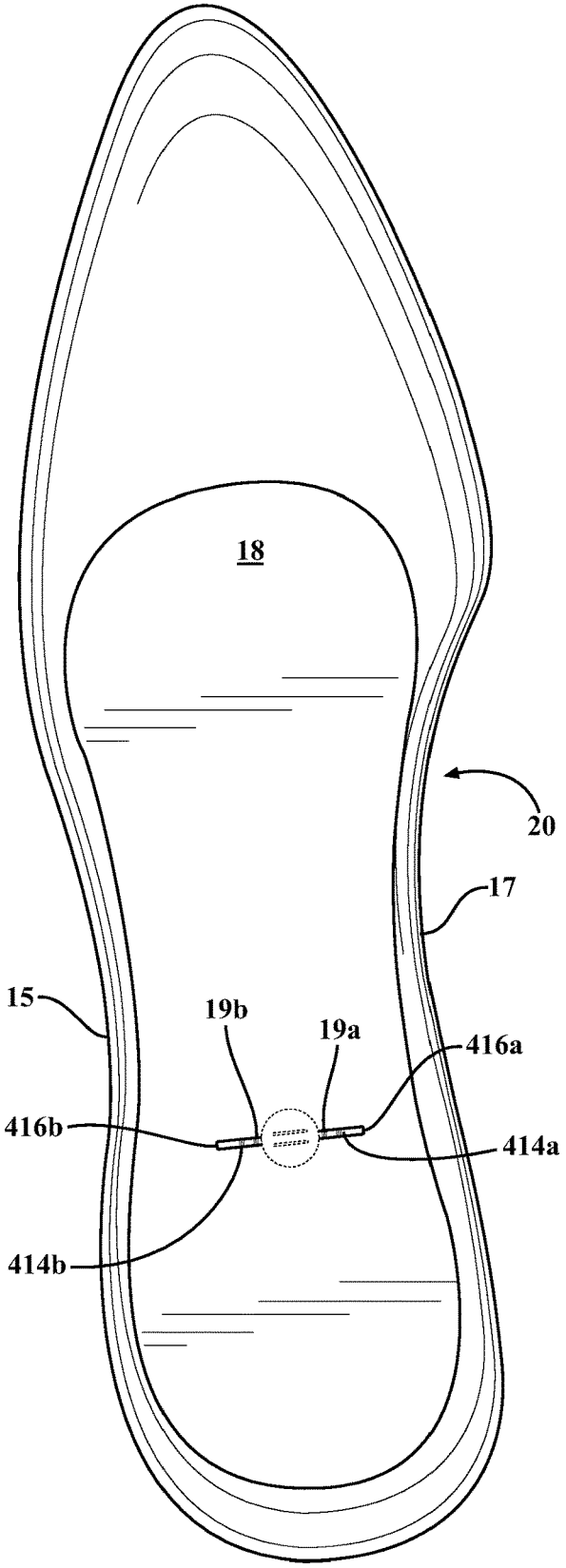
FIG. 26 is a top plan view of the sole of the shoe of FIG. 23*a*.

A method of providing a shoe 10 comprising charm holder device 332 will now be described with reference to FIG. 26. In accordance with the method, a shoe sole is provided which comprises an outsole 20 and an insole 18. The outsole 20 will be exposed and will face the ground when the shoe is in use. Two openings 19*a* and 19*b* are drilled through the sole from the outsole 20 to the insole 18 (FIG. 26) and are spaced apart by a distance that is the same or substantially the same as the distance between the respective first ends 415*a* and 415*b* of the first and second stakes

414*a* and 414*b* along the k axis of the charm holder device 332. In the example of FIG. 26, the openings 19*a* and 19*b* are spaced apart from one another along the axis defined between the lateral side 15 and medial side 17 of the shoe 10, which is the z axis of the shoe 10 in FIG. 26. Thus, in FIG. 26 the i axis of the charm holder device 332 is parallel or substantially parallel to the z-axis of the shoe 10 (of FIG. 23*b*).

Charm holder device 332 is provided in the configuration of FIG. 25*a*, but as indicated previously, the stakes 414*a* and 414*b* may be substantially straight and not bent about second bending axes $Bi_c$ and $Bi_d$. The respective second ends 416*a* and 416*b* of stakes 414*a* and 414*b* are inserted through a respective opening 19*a* and 19*b* in outsole 20 and insole 18. To facilitate the insertion, each stake 414*a* and 414*b* may be bent about its respective second bending axis $Bi_c$ and $Bi_d$ to rotate first stake second region 419*a* away from second stake second region 419*b* and increase the angle defined between first region 417*a* and second region 419*a* of first stake 414*a* and the angle defined between the first region 417*b* and second region 419*b* of second stake 414*b*. The rotation will increase the k axis spacing between the respective second ends 416*a* and 416*b* of the first stake 414*a* and second stake 414*b* and will generally cause the stakes 414*a* and 414*b* to assume a straighter configuration. The stakes 414*a* and 414*b* may also be rotated about their first bending axes $Bi_a$ and $Bi_b$ so that each stake's first region 417*a* and 417*b* is perpendicular or substantially perpendicular to the upper surface 394 of base plate 393 to facilitate insertion into outsole openings 19*a* and 19*b*.

Once the stakes 414*a* and 414*b* are inserted through the outsole openings 19*a* and 19*b*, each stake 414*a* and 414*b* may be further rotated about its first bending axis $Bi_a$ and $Bi_b$ so that their respective second stake ends 416*a* and 416*b* are rotated away from one another to the configuration of FIG. 25*b*. The stakes 414*a* and 414*b* are then partially or wholly flattened or substantially flattened into abutting engagement with the insole 18 (FIG. 26). A portion of an upper 33 that covers the top of the foot and/or a sock insole lining (if the upper is to be done as a sandal) is then adhesively attached to and applied over the insole 18 to conceal the stakes 414*a* and 414*b* from view. Heel 14 is then attached to outsole 20 such as by using glue and/or mechanical fasteners (e.g., a nail).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A shoe, comprising: an outsole having an inner surface, an outer surface, a first portion, and a second portion, wherein the first portion is a ground-contacting portion, and the second portion is spaced apart from the ground contacting portion along a shoe height axis; and a charm holder device attached to the second portion of the outsole, the charm holder device comprising: a base plate having an upper surface and a lower surface; first and second stakes attached to the base plate, wherein the first and second stakes have respective first ends attached to the base plate and respective second ends spaced apart from the base plate, the first and second stakes are bendable about respective first and second bending axes, and the first and second bending axes are parallel to the base plate lower surface and spaced apart from the base plate lower surface; and a charm keeper projecting away from the lower surface of the base plate.

2. The shoe of claim 1, wherein the charm keeper comprises a member having first and second ends attached to the base plate lower surface, the first and second member ends are spaced apart from one another along a third axis, and the member comprises a central portion spaced apart from the base plate lower surface along a fourth axis.

3. The shoe of claim 1, wherein the charm keeper defines an opening between the charm keeper and the base plate.

4. The shoe of claim 1, wherein the first and second stakes have a first configuration, wherein when the first and second stakes are in the first configuration, the second end of the first stake is spaced apart from the second end of the second stake by a first distance along a third axis.

5. The shoe of claim 4, wherein the first and second stakes have a second configuration, wherein when the first and second stakes are in the second configuration, the second end of the first stake is spaced apart from the second end of the second stake by a second distance along the third axis, and the second distance is greater than the first distance.

6. The shoe of claim 5, wherein when the first and second stakes are in the first configuration, the second ends of the first and second stakes are spaced apart from the upper surface of the base plate by a third distance along a fourth axis, and when the first and second stakes are in the second configuration, the second ends of the first and second stakes are spaced apart from the upper surface of the base plate by a fourth distance along the fourth axis, and the third distance is greater than the fourth distance.

7. The shoe of claim 1, wherein the first and second stakes are bendable about respective third and fourth bending axes, and the respective third and fourth bending axes are parallel to the first and second bending axes.

8. The shoe of claim 1, wherein the respective first ends of the first and second stakes are attached to the upper surface of the base plate.

9. The shoe of claim 1, wherein the respective first ends of the first and second stakes are spaced apart from one another along a third axis.

10. The shoe of claim 1, wherein the respective first and second bending axes are spaced apart from the upper surface of the base plate.

11. The shoe of claim 1, wherein the base plate comprises an opening extending from the lower surface of the base plate to the upper surface of the base plate.

12. The shoe of claim 11, wherein the charm keeper has a length and a width, the charm keeper length is greater than the charm keeper width, the opening has a length and a width, the opening length is greater than the opening width, and the opening width is greater than the charm keeper width.

13. The shoe of claim 12, wherein the base plate, the first stake, and the second stake consist essentially of nickel.

14. The shoe of claim 1, further comprising a heel spaced apart from the ground contacting portion of the outsole along a shoe length axis, wherein the second portion of the outsole is located between the heel and the ground-contacting portion of the outsole along the shoe length axis.

15. The shoe of claim 1, wherein the second portion of the outsole is oriented at a non-orthogonal angle relative to the ground-contacting portion of the outsole.

16. The shoe of claim 1, wherein the first and second stakes of the charm holder device extend through the outer surface and the inner surface of the outsole.

17. The shoe of claim 1, wherein the respective first and second ends of the first and second stakes project away from one another.

18. The shoe of claim 17, wherein the respective first ends of the first and second stakes are spaced apart from one another along a third axis that is perpendicular to the first bending axis and the second bending axis.

19. The shoe of claim 1, further comprising a charm having a charm clasp, wherein the charm clasp has an open configuration and a closed configuration, and the charm clasp engages the charm keeper and is in the closed configuration.

20. The shoe of claim 1, wherein the first and second stakes comprise metal materials.

21. The shoe of claim 1, wherein the first and second stakes consist essentially of metal materials.

22. The shoe of claim 1, wherein the first and second bending axes are spaced apart from the base plate lower surface in a direction parallel to the lower surface.

* * * * *